US009198241B2

(12) United States Patent
Takeda

(10) Patent No.: US 9,198,241 B2
(45) Date of Patent: Nov. 24, 2015

(54) LED ILLUMINATION APPARATUS AND LED ILLUMINATION SYSTEM

(71) Applicant: MITSUBISHI CHEMICAL CORPORATION, Chiyoda-ku (JP)

(72) Inventor: Toru Takeda, Chiyoda-ku (JP)

(73) Assignee: MITSUBISHI CHEMICAL CORPORATION, Chiyoda-ku (JP)

( * ) Notice: Subject to any disclaimer, the term of this patent is extended or adjusted under 35 U.S.C. 154(b) by 134 days.

(21) Appl. No.: 13/850,698

(22) Filed: Mar. 26, 2013

(65) Prior Publication Data

US 2013/0241428 A1 Sep. 19, 2013

Related U.S. Application Data

(63) Continuation of application No. PCT/JP2011/062970, filed on Jun. 6, 2011.

(30) Foreign Application Priority Data

Sep. 27, 2010 (JP) ..... 2010-216156
Jun. 3, 2011 (JP) ..... 2011-125158

(51) Int. Cl.
*H05B 37/02* (2006.01)
*H05B 33/08* (2006.01)

(52) U.S. Cl.
CPC ..... *H05B 33/0815* (2013.01); *H05B 33/0827* (2013.01); *H05B 33/0863* (2013.01)

(58) Field of Classification Search
CPC ..... H05B 37/02; H05B 37/0281; H05B 33/0815; H05B 33/0803; H05B 33/0863; H05B 33/0896; Y02B 20/44; Y02B 20/46; Y02B 20/346
USPC ..... 315/291, 294, 297, 307, 308, 312, 360, 315/169.1, 169.3; 307/31
See application file for complete search history.

(56) References Cited

U.S. PATENT DOCUMENTS 6,510,995 B2 * 1/2003 Muthu et al. ..... 235/454
7,649,327 B2 * 1/2010 Peng ..... 315/312

(Continued)

FOREIGN PATENT DOCUMENTS

CN 101340760 A 1/2009
CN 101341462 A 1/2009

(Continued)

OTHER PUBLICATIONS

International Search Report issued on Sep. 6, 2011 for PCT/JP2011/062970 filed on Jun. 6, 2011 with English Translation.

(Continued)

*Primary Examiner* — Haissa Philogene
(74) *Attorney, Agent, or Firm* — Oblon, McClelland, Maier & Neustadt, L.L.P.

(57) ABSTRACT

An LED lighting apparatus connected to a power source via two electric lines, includes first and second LEDs having different emission spectrum or chromaticity, a switching unit to monitor ON time length of power supplied from the two electric lines periodically to switch a control mode of the first and second LEDs between first and second modes as a condition that the ON time is not changed continues for more than a threshold value, a first control unit to determine, in the first mode, a total amount of average current to be supplied to the first LED and to the second LED depending on the ON time length of the electric power, and a second control unit to determine, in the second mode, a ratio of average currents to be supplied to the first LED and to the second LED depending on the ON time length.

12 Claims, 9 Drawing Sheets

(56) References Cited

U.S. PATENT DOCUMENTS

| | | | | |
|---|---|---|---|---|
| 8,410,727 | B2 * | 4/2013 | Mizuno | 315/313 |
| 8,441,202 | B2 * | 5/2013 | Wilson et al. | 315/291 |
| 8,446,108 | B2 * | 5/2013 | Zhang et al. | 315/307 |
| 8,664,883 | B2 * | 3/2014 | Hiramatu et al. | 315/291 |
| 8,810,141 | B2 * | 8/2014 | Takeda et al. | 315/201 |
| 2008/0259590 | A1 | 10/2008 | De Goederen - Oei | |
| 2009/0015759 | A1 | 1/2009 | Honbo | |

FOREIGN PATENT DOCUMENTS

| | | |
|---|---|---|
| JP | 01-138964 | 5/1989 |
| JP | 2000-150174 | 5/2000 |
| JP | 2004-111104 | 4/2004 |
| JP | 2005-063803 | 3/2005 |
| JP | 2005-524960 | 8/2005 |
| JP | 2008-108598 | 5/2008 |
| JP | 2008-305759 | 12/2008 |
| JP | 2009-16280 | 1/2009 |
| JP | 2009-521087 | 5/2009 |
| WO | 03/096761 | 11/2003 |

OTHER PUBLICATIONS

Combined Office Action and Search Report issued Dec. 17, 2013 in Chinese Patent Application No. 201180011877.5 with English language translation.

Office Action issued Dec. 9, 2014, in Japanese Patent Application No. 2011-210281 w/English language Translation.

* cited by examiner

LED ILLUMINATION APPARATUS AND LED ILLUMINATION SYSTEM

CROSS-REFERENCE TO RELATED APPLICATION

This is a continuation of Application PCT/JP2011/062970, filed on Jun. 6, 2011, now pending, and claims priority from Japanese Patent Application 2010-216156 which was filed on Sep. 27, 2010 and Japanese Patent Application 2011-125158 which was filed on Jun. 3, 2011, the contents of which are herein wholly incorporated by reference.

FIELD

The disclosure relates to an LED (Light Emitting Diode) illuminator (LED lighting apparatus) and an LED illumination system.

BACKGROUND

In recent years, as one of lighting apparatus instead of an incandescent bulb, an LED bulb using LED begin to come into widespread use. When an LED bulb instead of an incandescent bulb is applied, it is tried to reduce costs for introducing the LED bulb by utilization of wiring equipment and a light dimmer built-in an existing construction.

For example, in a circuit connection to an incandescent bulb, each of an incandescent bulb having two terminals and a triac light dimmer having two terminals for incandescent bulbs are used. One of the two terminals included in the triac light dimmer is connected to a commercial power source, and the other of the two terminals is connected to one of terminals included in the incandescent bulbs. The other terminal included in the incandescent bulb is connected to the commercial power source. Thus, the triac light dimmer and the incandescent bulb are series-connected with the commercial power source.

The triac light dimmer includes, for example, a main power source of the incandescent bulb, an operation unit for adjusting a luminance of the incandescent bulb (a rotary knob or a sliding knob), and a triac that ignition timing is adjusted in response to an operation amount of the operation unit. A voltage supplied from the commercial power source is supplied to the incandescent bulb during an ignition time from the triac being turned on to the voltage becoming zero.

Patent Document 1: Japanese National Publication of International Patent Application No. 2005-524960

Wiring lines, as described above, for series-connecting the triac light dimmer and the incandescent bulb to the commercial power source are usually provided in a wall or at a back of a ceiling when a construction is built. Hence, there is a probability that change of structure of the wiring lines brings on destroy of the wall or the ceiling.

In contrast to this, if an LED illumination apparatus can be introduced introduce by using existing wiring lines and existing triac light dimmer, it is preferred in view of reducing initial costs relating to introduction of the LED illumination apparatus. Further, in a status that existing wiring structure is maintained, if a luminance and a color temperature of the LED illumination apparatus are adjustable, it is able to provide momentum to introduce the LED illumination apparatus instead of the traditional incandescent bulb to customers.

However, in an existing LED illumination system including a wiring line structure that a light dimmer and an LED illumination apparatus are series-connected to a commercial power source, there is no LED illumination system which is adjustable both of the luminance and the color temperature.

SUMMARY

A first aspect is an LED illumination apparatus configured to be connected with a light adjustment apparatus, which is connected with a power source via a single first power feeding line, via a single second power feeding line, configured to be connected with the power source via a single third power feeding line, and configured to receive an AC current supplied from the power source during a conduction time depending on an ignition phase angle of a conduction control unit in response to an operation amount of a user interface included in the light adjustment apparatus, the LED illumination apparatus comprising:

first and second LED modules configured to emit lights having a same color with different emission spectra or lights having different colors;

a measurement unit configured to measure the ignition phase angle and time change of the ignition phase angle;

a light adjusting unit configured to supply a driving current, by using the received AC current, for the first and second LED modules emitting a light having a luminance depending on the ignition phase angle;

a color adjusting unit configured to supply a driving current, by using the received AC current, for the first and second LED modules emitting a light having a color temperature depending on the ignition phase angle;

a selecting unit configured to switch a control mode to be select based on the time change of the ignition phase angle between a light adjustment mode that a driving current adjusted by the light adjusting unit is supplied to the first and second LED modules and a color adjustment mode that a driving current adjusted by the color adjusting unit is supplied to the first and second LED modules;

a light adjustment control unit configured to control the light adjusting unit so that the first and second LED modules emit a light having a luminance based on the ignition phase angle in a state that the light adjustment mode is selected;

a color adjustment control unit configured to control the color adjusting unit so that the first and second LED modules emit a light having a color temperature depending on the ignition phase angle in a state that the color adjustment mode is selected.

The first and second LED modules in the first aspect and a second to fourth aspects described below, and first and second LED in fifth and sixth aspects described below may have different "emission spectra" or "chromaticity." The chromaticity includes a hue and a color temperature. Further, the term of "depending on the time change of the ignition phase angle" includes both of a case where a time change of the ignition phase angle as such is measured and a case where a time change of a conduction time depending on the ignition phase angle is measured.

The first aspect may be configured so that the selecting unit selects either the light adjustment mode or the color adjustment mode when a main power source of the LED illumination apparatus is turned on, and switches one of the light adjustment mode and the color adjustment mode into the other mode in a condition that a time for the ignition phase angle not to change exceeds a threshold value in one of the light adjustment mode and the color adjustment mode.

Further, the first aspect may be configured so that the selecting unit maintains the light adjustment mode when the time change of the ignition phase angle is within a given range in a state that the light adjustment mode is selected, and the light adjusting unit supplies a driving current of an average current value corresponding to magnitude of the ignition phase angle.

Moreover, the first aspect may be configured so that the color adjusting unit, in a state that the color adjustment mode is selected, adjusts a ratio of driving currents which are supplied to the first and second LED modules so that the color temperature is raised in a reduction tendency of the ignition phase angle while the color temperature is decreased in an increasing tendency of the ignition phase angle.

The LED illumination apparatus in the first aspect may be configured to further include a pair of two terminals consisting of a first terminal connected with the light adjustment apparatus via one of a pair of power feeding lines and a second terminal connected with the power source via the other of the pair of power feeding lines.

The LED illumination apparatus in the first aspect may be configured to further include an electric storage unit configured to store electrical charge for the light adjusting unit or the color adjusting unit continuing supply of the driving current using the received AC current after the conduction time.

A second aspect is an LED illumination system, comprising:

a light and color adjusting apparatus connected with a power source via a single feeding line; and an LED illumination apparatus including a first terminal connected with the light and color adjusting apparatus via one of a pair of feeding lines and a second terminal connected with the power source via the other of the pair of feeding lines, wherein the light and color adjusting apparatus including:

a first user interface to adjust a luminance;

a second user interface to adjust a color temperature; and a first shaping unit configured to form a waveform including a luminance control signal corresponding to an operation amount of the first user interface from an AC voltage waveform supplied from a power source; and a second shaping unit configured to form a waveform including a color temperature control signal corresponding to an operation amount of the second user interface from an AC voltage waveform supplied from the power source, wherein the LED illumination apparatus including:

a pair of terminals, one of the pair of terminals being connected with the light and color adjusting apparatus and the other of the pair of terminals being connected with the power source;

first and second LED modules configured to emit lights having a same color with different emission spectra or lights having different colors;

a judging unit configured to determine whether the received AC voltage waveform includes the luminance control signal or includes the color temperature control signal;

a light adjusting unit configured to supply a driving current for adjusting a luminance to the first and second LED modules;

a color adjusting unit configured to supply a driving current for adjusting a color temperature to the first and second LED modules;

a light adjustment control unit configured to control the light adjusting unit so that the first and second LED modules emit a light having a luminance corresponding to the luminance control signal; and a color adjustment control unit configured to control the color adjusting unit so that the first and second LED modules emit a light having a color temperature corresponding to the color temperature control signal.

The second aspect may be configured so that one of the first shaping unit and the second shaping unit generates a section that a voltage of a given amount is reduced in both of positive and negative cycles of the AC voltage waveform depending on an operation amount of the first user interface or the second user interface;

the other of the first shaping unit and the second shaping unit generates a section that a voltage of a given amount is reduced in one of positive and negative cycles of the AC voltage waveform depending on an operation amount of the first user interface or the second user interface;

the judging unit judges whether the AC voltage waveform includes the luminance control signal or includes the color temperature control signal by determining whether the section that the voltage of the given amount is reduced is changed in both of the positive and negative cycles of the AC voltage waveform or not.

For example, the first shaping unit and the second shaping unit may be configured so that, depending on the operation amount of the first user interface, a section that the voltage the given amount is reduced in both of positive and negative cycles of the AC voltage waveform is generated, and, depending on the operation amount of the second user interface, a section that the voltage the given amount is reduced in one of positive and negative cycles of the AC voltage waveform is generated. The judging unit may be configured to judge that the AC voltage waveform include the luminance control signal when a voltage reduction section is varied in both of positive and negative cycles, and to judge that the AC voltage waveform include the color temperature control signal when a voltage reduction section is varied in one of positive and negative cycles.

The second aspect may be configured so that the light adjustment control unit controls the light adjusting unit so that the luminance becomes lower according to decrease of a phase angle indicating a position of the luminance control signal within the AC voltage waveform.

The second aspect may be configured so that the color temperature adjustment control unit controls the color adjusting unit so that a color temperature becomes higher according to decrease of a phase angle indicating a position of the luminance control signal within the AC voltage waveform.

A third aspect is a light adjustment and color adjustment apparatus in the second embodiment.

A fourth aspect is an LED illumination apparatus in the second embodiment.

A fifth aspect is an LED lighting apparatus connected to a power source via two electric lines, comprising:

a first LED and a second LED which have different emission spectrum or chromaticity each other;

a switching unit configured to monitor a length of ON time of electric power being supplied from the two electric lines periodically, and configured to switch a control mode of the first LED and the second LED between a first mode and a second mode as a condition that a state that the ON time is not changed continues more than a threshold value;

a first control unit configured to determine, in the first mode, a total amount of an average current to be supplied to the first LED and an average current to be supplied to the second LED depending on the length of the ON time of the electric power; and a second control unit configured to determine, in the second mode, a ratio of an average current to be supplied to the first LED and an average current to be supplied to the second LED depending on the length of the ON time of the electric power.

The fifth aspect may be apply a configuration further including a non-volatility storage medium configured to store mode information indicating the control mode in a current, and the total amount and the ratio in a current.

A sixth aspect is an LED lighting apparatus connected to a power source via two electric lines, comprising:

a first LED and a second LED which have different emission spectrum or chromaticity each other;

a detecting unit configured to detect light adjustment information and color adjustment information from a periodical voltage or current waveform supplied from the two electric lines;

a first control unit configured to determine a total amount of an average current to be supplied to the first LED and an average current to be supplied to the second LED depending on the light adjustment information; and a second control unit configured to determine a ratio of an average current to be supplied to the first LED and an average current to be supplied to the second LED depending on the color adjustment information.

The sixth aspect may be apply a configuration further including a non-volatility storage medium configured to store the total amount and the ratio in a current.

DETAILED DESCRIPTION OF EMBODIMENTS

Embodiments of the present invention will be explained below with reference to the drawings. Embodiments are exemplified as configured by way of example. The present invention is not limited to the configuration or arrangement of Embodiments.

First Embodiment

A first embodiment of an LED illumination apparatus (illuminator) will be explained below. In the first embodiment, both of lighting control (adjustment of luminance) and color control (adjustment of color temperature) are realized by utilization of a light adjustment apparatus (dimmer) having a wall-embedded type in a room is utilized wall and utilization of existing two wiring lines, without performing work of construction for replacing wiring lines.

Figure 1:
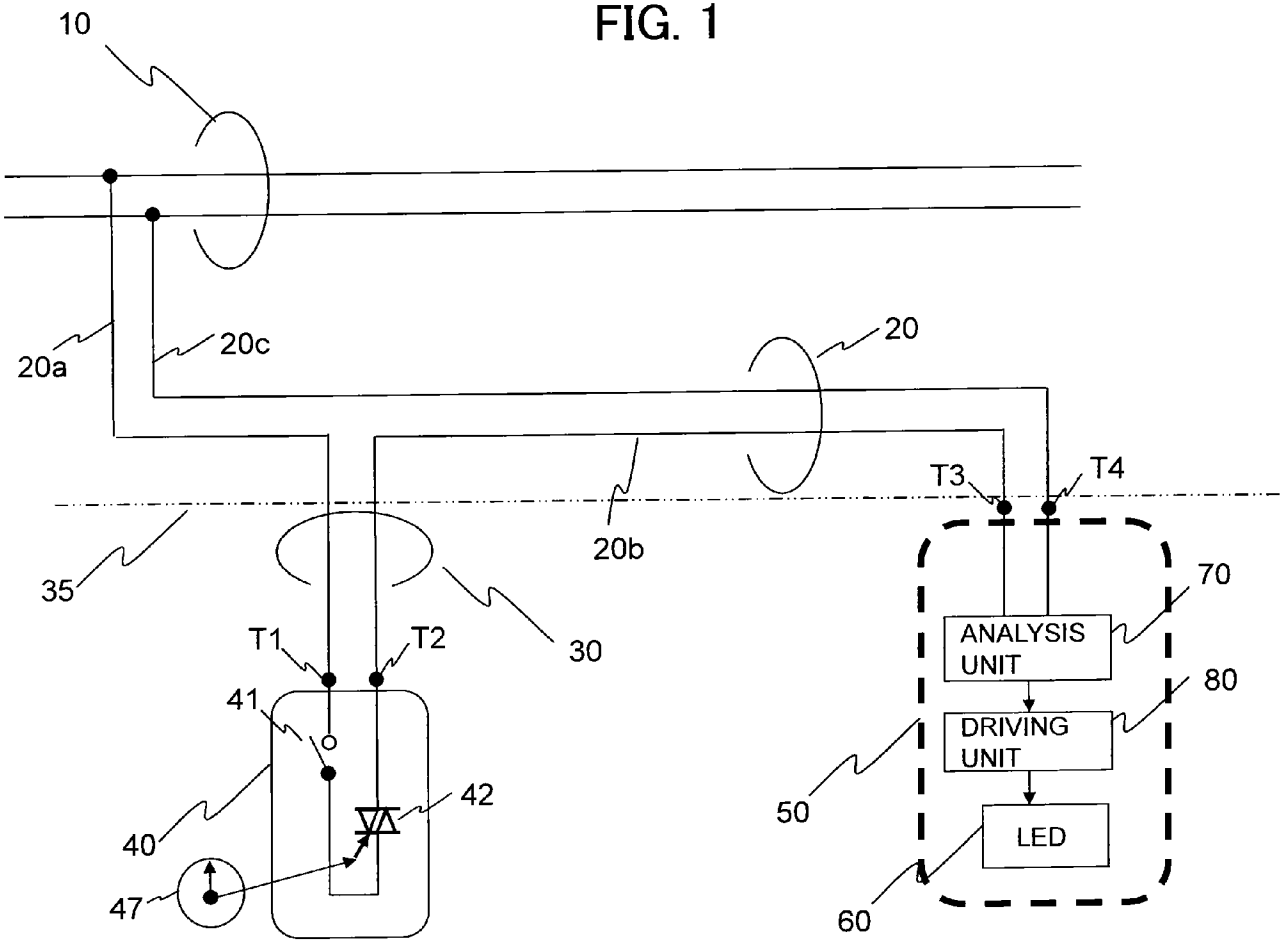
FIG. 1 is a schematic explanation diagram of an illumination system including an LED illumination apparatus being an LED lighting apparatus related to a first embodiment.
Figure 2:
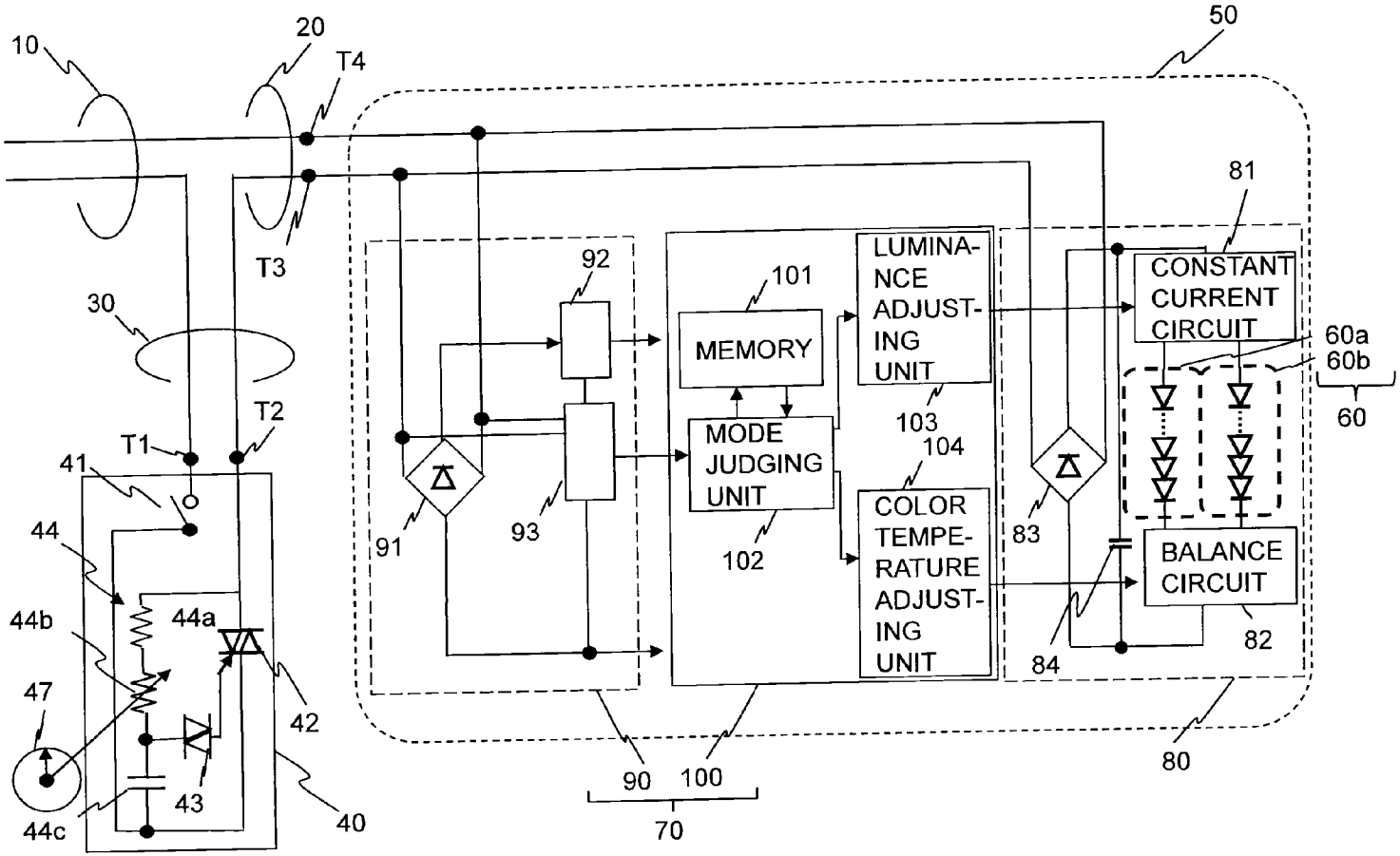
FIG. 2 is a diagram illustrating a detailed configuration example of the illumination system depicted in FIG. 1.

FIG. 1 is a schematic explanation diagram of an illumination system including an LED illumination apparatus 50 being an LED lighting apparatus related to the first embodiment, and FIG. 2 is a diagram illustrating a detailed configuration example of the illumination system depicted in FIG. 1.

FIG. 1 is scheme of circuit configuration for the illumination system. FIG. 1 illustrates, with a boundary of an imaginary line (virtual line) 35 depicted by a two-dot chain line, an electrical wiring line installation space (on the upper side of the imaginary line 35) and an installation space for the LED illumination system (on the lower side of the imaginary line 35). In the installation space for the illumination system, a light adjustment apparatus 40 and an LED illumination apparatus 50 are connected with wiring lines pulled out from the electrical wiring line installation space.

The electrical wiring line installation space is usually provided in a wall or at a back of the ceiling, which is isolated from the illumination system installation space by the wall or the ceiling. In the example illustrated in FIG. 1, wiring line configuration for existing illumination apparatus such as an incandescent bulb and a fluorescent lamp is illustrated. That is, in the electrical wiring line installation space, a pair of commercial power source bus lines 10 to which the commercial power source (for example, alternating current (AC) 100 V, 50 Hz) is supplied, a pair of power feeding lines 20, and a pair of lead-in lines 30 which are provided for flashing the illumination apparatus are arranged.

The light adjustment apparatus 40 including a pair of two terminals T1, T2 is connected to the lead-in lines 30 for flashing the illumination apparatus. On the other hand, an illumination apparatus including a pair of terminals is connected to the power feeding lines 20. In, FIG. 1, the LED illumination apparatus 50, which includes a pair of terminals T3, T4, instead of the incandescent bulb is connected.

In FIG. 1, the power feeding lines 20 and the lead-in lines 30, for example, consist of a feeding line 20*a* (first feeding line) and 20*c* (third feeding line) pulled out from the bus lines 10, and a feeding line 20*b* (second feeding line) for connecting the light adjustment apparatus 40 with the LED illumination apparatus.

That is, each of the terminals T1, T2 of the light adjustment apparatus 40 are connected to the feeding lines 20*a* and 20*b*. The terminal T3 of the LED illumination apparatus 50 is connected to the feeding line 20*b*. The terminal T4 of the LED illumination apparatus is connected to one of the bus lines 10. Thus, the light adjustment apparatus 40 and the LED illumination apparatus 50 are series-connected to the commercial power source (the bus lines 10).

As described above, the electrical wiring line installation space which the commercial power source bus lines 10, the feeding lines 20 for illumination apparatus and the lead-in lines 30 are arranged is separated by the wall or the ceiling. The light adjustment apparatus 40 is set on the wall. The LED illumination apparatus is set by fixtures provided with the wall or the ceiling, then, the LED illumination apparatus 40 is electrically connected with the feeding lines 20 via a socket or a connector.

In FIG. 1, there are not few cases where a part of the wall or ceiling is destroyed in order to change an arrangement of wiring lines in the electrical wiring line installation space. Therefore, to change an illumination apparatus from the incandescent bulb to the LED illumination apparatus, the changing of the arrangement of wiring lines in the electrical wiring line installation space is impossible in view of the structure of the construction or needs large costs. In contrast, if the light adjustment apparatus for the incandescent bulb can apply to the LED illumination apparatus, it is preferred in a point that initial costs introducing the LED illumination apparatus may be reduced.

The light adjustment apparatus 40 illustrated in FIG. 1 is a light adjustment box for existing incandescent bulb. The light adjustment apparatus 40 includes a switch (main power source switch) 41 for flashing the LED illumination apparatus 50, a triac 42 (conduction control unit) to control AC supplied to the LED illumination apparatus, an operation unit (user interface) 47 to operate a conduction period of time (ignition phase angle) of the triac 42.

On the other hand, the LED illumination apparatus 50 illustrated in FIG. 1 includes an LED emission unit 60 (hereafter, "LED 60"), an analysis unit 70 to analyze a control operation by the operation unit 47 from a power source waveform (AC waveform) from the light adjustment apparatus 40, and an LED driving unit 80 (hereafter, "driving unit 80") to drive the LED emission unit 60 base on an analysis result of the analysis unit 70.

Details of the light adjustment apparatus 40 and the LED illumination apparatus 50 will be explained by use of FIG. 2. In FIG. 2, the light adjustment apparatus 40 includes the terminals T1 and T2, a main power source switch 41, the triac 42, and a trigger diode 43 and a time constant circuit 44.

The terminals T1 and T2 are connected to the lead-in lines 30 in order to supply the electric power from the commercial power source (AC 100V, 50 Hz) into the light adjustment apparatus 40.

The triac 42 is turned ON (ignited) by receiving the trigger signal from the trigger diode 43 in the positive/negative half cycle in 1 cycle of the AC current to continuously supply the positive or negative voltage (current) to the terminal T2 until the concerning half cycle is completed. The trigger diode 43 supplies the trigger signal to the triac 42 in order to ignite the triac 42.

The time constant circuit 44 controls the timing at which the trigger diode 43 supplies the trigger signal to the triac 42. The time constant circuit 44 has a resistor 44*a*, a variable resistor 44*b*, and a capacitor (condenser) 44*c*, and the time constant circuit 44 is connected to the trigger diode 43. The resistance value of the variable resistor 44*b* is varied depending on the operation amount of the operation unit 47.

The resistor 44*a*, the variable resistor 44*b*, and the capacitor 44*c* constitute a CR time constant circuit which charges the application voltage to the trigger diode 43 in the positive half cycle (former half of the cycle) of the AC current, and the trigger diode 43 is turned ON in accordance with the time constant determined by the resistance values and the capacitance value thereof.

FIG. 2 illustrates the time constant circuit 44 which ignites the triac 42 in the positive half cycle. However, the light adjustment apparatus 40 also includes a time constant circuit (unillustrated) which ignites the triac 42 in the negative half cycle. The light adjustment apparatus 40 may further include a hysteresis removing circuit which removes the hysteresis by removing the residual electric charge of the capacitor 44*c* in the positive and negative half cycles.

Figure 3:
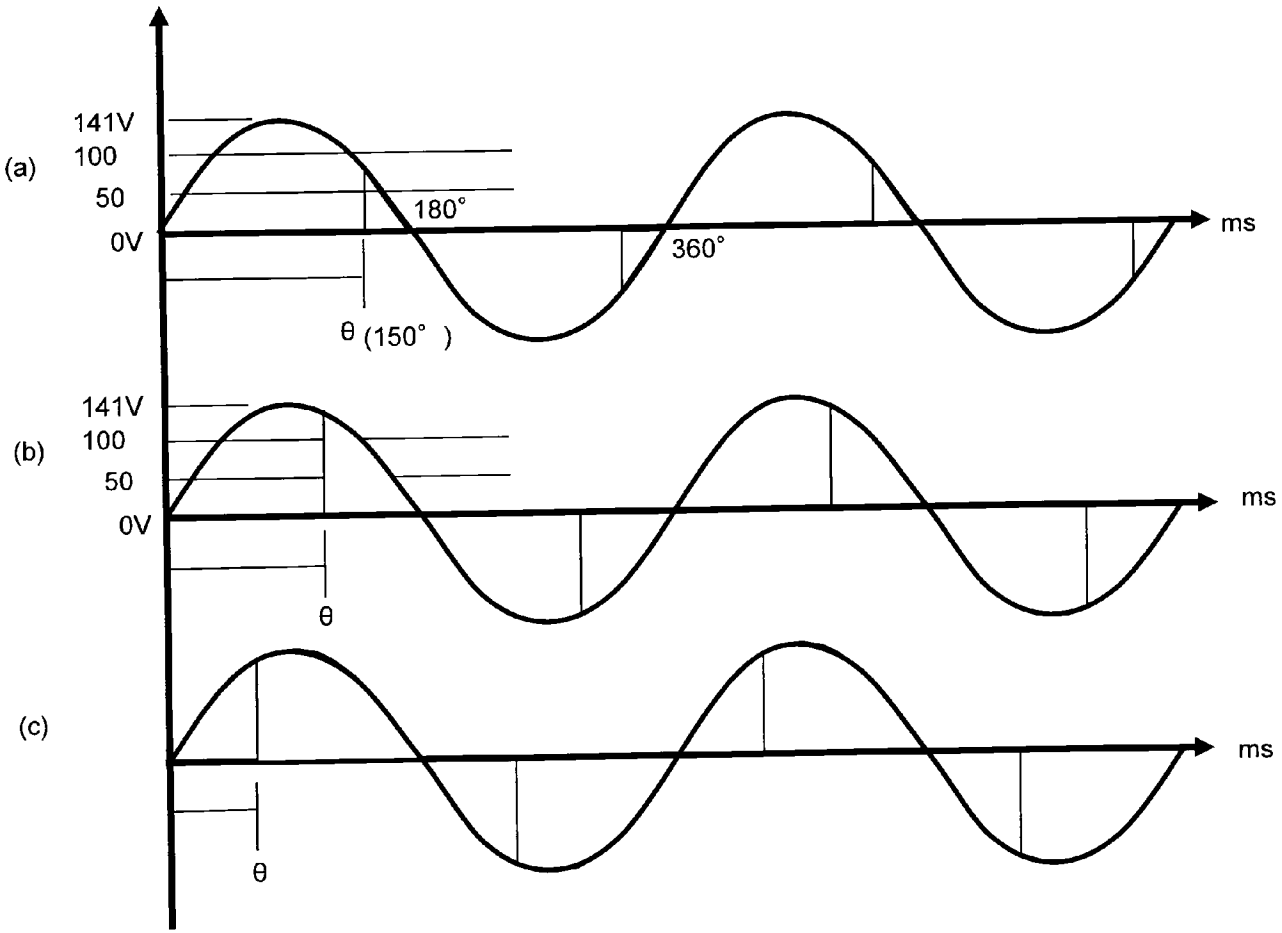
FIG. 3 is a diagram indicating a relationship between an AC current waveform of a commercial power source charged to a light adjustment apparatus and AC voltage supplied to an LED lighting apparatus by ignition of a triac.

FIG. 3 illustrates the relationship between the AC waveform of the commercial power source applied to the light adjustment apparatus 40 and the AC voltage supplied to the LED illumination apparatus 50 in accordance with the ignition of the triac 42. As illustrated in FIG. 3 (*a*), the AC voltage of sine curve is applied from the commercial power source to the light adjustment apparatus 40. In the positive half cycle, the positive charge is started with respect to the capacitor 44*c* of the time constant circuit 44 simultaneously with the start of the voltage application. The trigger diode 43 supplies the trigger signal to the triac 42 at the time at which the electric charge charged in the capacitor 44*c* is in a given amount. Accordingly, the triac 42 is ignited at a predetermined angle θ in the positive half cycle to start the supply of the positive current to the LED illumination apparatus 50. The current supply is continued until the half cycle is completed. The same or equivalent operation is also performed in the negative half cycle.

In this way, the triac 42 is ignited at the timing in accordance with the time constant of the time constant circuit 44 in each of the positive and negative half cycles to supply the AC electric power to the LED illumination apparatus 50. That is, the triac 42 allows the AC current supplied from the commercial power source to be in conduction at the ignition time.

The time constant is changed depending on the resistance value of the variable resistor 44*b*. That is, the smaller the resistance value of the variable resistor 44*b* is, the smaller the time constant is, wherein the timing, at which the triac 42 is ignited, is advanced (see (*b*) and (*c*) in FIG. 3). The ignition phase angle (conduction time) of the triac 42 can be made variable by changing the resistance value of the variable resistor 44*b* in accordance with the operation of the operation unit 47 as described above.

With reference to FIG. 2, the LED illumination apparatus 50 includes a microcomputer 100 and an ignition phase angle detection circuit 90 to function as an analyzing unit 70, and a driving unit (driving circuit) 80 for the LED 60.

The ignition phase angle detection circuit 90 includes a rectifier circuit 91 which converts, into the DC current, the AC current supplied in accordance with the control of the ignition phase angle of the triac 42 of the light adjustment apparatus 40, a constant voltage source 92 which generates the DC voltage for the operation of the microcomputer 100 from the DC voltage outputted from the rectifier circuit 91, and an angle detection circuit 93 which detects the ignition phase angle of the triac 42.

The microcomputer 100 includes a memory (storage device) 101, a mode judging unit 102 as selecting means, a luminance adjusting unit 103 as a luminance control unit, and a color temperature adjusting unit 104 as a color temperature control unit. The memory 101 stores program(s) to be executed by a processor included in the microcomputer 100 and data to be used when the program is executed. Further, the memory 101 has a recording area for recording the history of the conduction time determined from the ignition phase angle.

The mode judging unit 102 switches the control mode of the LED 60 between a light adjustment mode in which the luminance of the LED 60 is adjusted and a color adjustment mode in which the color temperature of the LED 60 is adjusted, by making reference to the history of the conduction time.

That is, the mode judging unit 102 selects the light adjustment mode as the initial setting when the main power source switch 41 is turned ON. The mode judging unit 102 receives the ignition phase angle of each 1 cycle from the angle detection circuit 93 to calculate the conduction time in the half cycle of the triac 42 from the ignition phase angle. For example, the conduction time is determined as the difference C between the point in time A of the ignition start of the triac 42 and the point in time B of the completion (voltage 0) of the half cycle.

The time per unit angle (for example, 1 degree) in the half cycle can be determined from the frequency of the AC current (50 Hz, 1 cycle: 20 ms in the embodiment). That is, the conduction time can be calculated as (180 [°]−ignition angle [°])×(time per 1 degree=about 0.056 [ms]).

In the light adjustment mode, the mode judging unit 102 gives the conduction time to the luminance adjusting unit 103, and the mode judging unit 102 records the conduction time in the memory 101. Accordingly, the history of the conduction time in each 1 cycle is stored in the memory 101.

The mode judging unit 102 calculates the difference from the last record of the conduction time in the memory 101 every time when the conduction time for 1 cycle is calculated (measured). If the difference is 0, the mode judging unit 102 starts the time measurement by means of a timer. If the time, in which the difference is 0 (time in which the conduction time is unchanged), exceeds a given time, the mode judging unit 102 switches the control mode into the color adjustment mode (color adjustment mode is selected). On the other hand, if the difference is detected during a period in which the time, in which the difference is 0, does not exceed the given time, then the mode judging unit 102 completes the time measurement by the timer, and the mode judging unit 102 maintains the selection of the light adjustment mode.

In the color adjustment mode, the mode judging unit 102 measures the conduction time for each 1 cycle in the same manner as in the light adjustment mode. The conduction time is recorded in the memory 101, and the difference between the conduction times of every one cycles is calculated. However, in the color adjustment mode, the conduction time for each 1 cycle is given to the color temperature adjusting unit 104. If the difference between the conduction times is 0, the mode judging unit 102 starts up the timer to measure the time in which the difference in the conduction times is 0, in the same manner as in the color adjustment mode. If the time, in which the difference in the conduction times is 0, exceeds a given time, the mode judging unit 102 switches the control mode into the light adjustment mode again (light adjustment mode is selected). However, if the difference is detected before the period, during which the difference maintain zero, exceed the predetermined time, then the mode judging unit 102 completes the time measurement by the timer, and the mode judging unit 102 maintains the selection of the color adjustment mode.

In this way, the mode judging unit 102 monitors the conduction time, and the mode judging unit 102 switches the control mode on condition that the time, in which the conduction time is unchanged, exceeds the predetermined time. The mode judging unit 102 imparts the conduction time to one of the luminance adjusting unit 103 and the color temperature adjusting unit 104 depending on the selected mode. In the foregoing explanation, the mode judging unit 102 supplies the conduction time for each 1 cycle to the luminance adjusting unit 103 or the color temperature adjusting unit 104. Alternatively, the mode judging unit 102 may supply the conduction time once a plurality of cycles, if necessary.

The luminance adjusting unit 103, which is provided as the luminance control unit, controls the constant current circuit 81 as the light adjusting means included in the driving circuit 80 so that the LED 60 emits the light at the luminance corresponding to the conduction time (ignition phase angle) supplied from the mode judging unit 102. For example, the luminance adjusting unit 103 has a map which indicates the correlation between the conduction time and the driving current, and the driving current, which corresponds to the conduction time, is determined from the map to control the constant current circuit 81 so that the driving current as described above is supplied.

The correlation between the conduction time and the driving current indicated in the map can be set arbitrarily. The length of the conduction time and the magnitude of the driving current may be in a proportional relationship. Alternatively, the relationship between the length of the conduction time and the driving current may be nonlinear. For example, the driving current may be increased in a stepwise manner depending on the length of the conduction time. In short, it is appropriate that the driving current value is increased when the user operates the operation unit 47 to raise the luminance, and the driving current value is lowered when the user operates the operation unit 47 to lower the luminance. It is also allowable that the increase/decrease in the driving current as described above is not in a proportional relationship with respect to the conduction time (ignition phase angle).

The constant current circuit 81 supplies the driving currents to the LED group 60*a* (first LED module) and the LED group 60*b* (second LED module), both constructing the LED 60 respectively. The driving current values are predetermined with respect to the conduction time (ignition phase angle) under the control of the luminance adjusting unit 103. The driving currents supplied to the LED 60 is sum of the driving current $I_{lowk}$ supplied to the LED group 60*a* and the driving current $I_{hik}$ supplied to the LED group 60*b*. The constant current circuit 81 increases/decreases the average values of the driving currents supplied to the LED groups 60*a*, 60*b* by increasing/decreasing the sum of the currents. Thus, the luminance of the LED 60 is increased or decreased.

The color temperature adjusting unit 104 as the color temperature control unit controls a balance circuit 82 as the color adjusting means included in the driving circuit 80 so that the LED 60 emits the light at the color temperature corresponding to the conduction time (ignition phase angle) in the color adjustment mode. The balance circuit 82 includes a pulse width modulation (PMW) circuit, which adjusts the ratio between the driving current (average current) $I_{lowk}$ supplied to the LED group 60*a* and the driving current (average current) $I_{hik}$ supplied to the LED group 60*b*. In this arrangement, the color temperature adjusting unit 104 has, for example, a map or a table which indicates the correlation between the conduction time and the driving current ratio. The balance circuit 82 is controlled so that the driving current $I_{lowk}$ and the driving current $I_{hik}$ are supplied at a predetermined driving current ratio depending on the conduction time.

The mode judging unit 102, the luminance adjusting unit 103, and the color temperature adjusting unit 104 may be constructed as the functions realized by executing the program by the processor included in the microcomputer 100. However, the mode judging unit 102, the luminance adjusting unit 103, and the color temperature adjusting unit 104 may be constructed by dedicated or generalized electronic circuit(s).

In the above-mentioned explanation, the microcomputer 100 functions as switching means (switching unit), first control means (first control unit), and second control means (second control unit). The mode judging unit 102 corresponds to the switching means, the luminance adjusting unit 103 corresponds to the first control means, and the color temperature adjusting unit 104 corresponds to the second control means.

In the explanation, the conduction time is calculated from the ignition phase angle. However, calculation of the conduction time and recording the history of the conduction time are not essential elements. That is, the history of the ignition phase angle instead of the conduction time may be recorded and driving control of the LED 60 (LED groups 60*a* and 60*b*) may be carried out in accordance with sum of or a ratio of the driving currents corresponding to the ignition phase angle.

In the first embodiment, the LED 60 resides in the light emission diode group manufactured, for example, on a sapphire substrate, comprising the set of LED group 60*a* and the LED group 60*b* which are arranged in parallel in the same direction and each of which includes a plurality of (for example, twenty) LED elements connected in series.

Each of the LED elements included in the LED groups 60*a*, 60*b* respectively has a light emission wavelength of 410 nm, and the terminal voltage is 3.5 V when the forward direction current is applied. When twenty LED elements are connected in series, the maximum light amount is generated with a DC current at 70 V.

A fluorescent member, which emits the white color at about 3000K when the fluorescent member is stimulated (excited) by the light having a light emission wavelength of 410 nm, is embedded or buried in each of the LED elements for constructing the LED group 60*a*. On the other hand, a fluorescent member, which emits the white color at about 5000K when the fluorescent member is stimulated (excited) by the light having a light emission wavelength of 410 nm, is embedded or buried in each of the LED elements for constructing the LED group 60*b*. Therefore, the chromaticity (color temperature) differs between the white light radiated by the light emission of the LED group 60*a* and the white light radiated by the light emission of the LED group 60*b*. The chromaticity includes hue and color temperature.

The numbers of the LED elements for constructing the LED groups 60*a*, 60*b* may be appropriately changed. One LED element is also available. It is appropriate that the LED groups 60*a*, 60*b* perform the light emission at the mutually different color temperatures. The color temperatures, which may be adopted for the respective LED groups 60*a*, 60*b*, may be appropriately selected. It is not necessarily indispensable that the LED 60 should be depending on the combination of the LED groups which emit the white lights having the different color temperatures. It is also allowable that the LED 60 is depending on a combination of LED groups which emit different colors. As for the combination of different colors, it is possible to apply any desired combination of, for example, green and blue or yellow and red. It is conceived that such an LED illumination apparatus may be utilized as a neon sign.

An explanation will be made in detail below about the operation of the operation unit 47 and the luminance adjustment (light adjustment) and the color temperature adjustment (color adjustment) of the LED 60.

The operation unit 47 of the light adjustment apparatus (dimmer box) 40 according to the first embodiment has a dial type knob (dial). However, the operation unit 47 may have a slide bar in place of the dial type knob.

In the first embodiment, when the light emission amount (luminance) of the LED illumination apparatus 50 is adjusted, then the knob of the operation unit 47 is rotated leftwardly (counterclockwise) to brighten the light, or the knob is rotated rightwardly (clockwise) to darken the light. However, the setting as described above is provided as the setting aimed for the convenience of explanation. That is, in the case of the light adjustment apparatus generally used at present, when the rotary type dial is rotated rightwardly in the clockwise direction, the conduction time is increased in the AC half cycle (for example, FIG. 3 (*a*)→FIG. 3 (*b*)). In this situation, the following setting is made. That is, when the illumination apparatus 40, which is connected to the light adjustment apparatus, is a constant resistance load such as an incandescent bulb, then the electric power consumption is increased, and the luminance of the incandescent bulb is raised.

The information about the angle of rotation (operation amount) of the operation unit 47 (dial) in the first embodiment is used to input the "information about the intention of the user," without being used to control the increase/decrease in the conduction time of the driving current with respect to the LED 60. Therefore, the operation amount of the operation unit 47 does not directly relate to the increase/decrease in the electric power consumption and the increase/decrease in the luminance of the load.

The electric power consumption of the LED 60 in the first embodiment is determined by the judgment of the control circuit (microcomputer 100) disposed on the side of the load independently from the ignition phase angle θ of the triac 42, unlike the incandescent bulb load which can be approximated by a genuine resistor.

An explanation will be made about the driving control for the LED 60 in the first embodiment by using the triac 42 with reference to FIG. 3. In the first embodiment, the luminance adjusting unit 103, which is contained in the LED illumination apparatus 50, determines the constant current value supplied to the LED 60 irrelevant to whether the conduction time of the triac 42 is long or short (irrelevant to the ignition phase angle) as illustrated in FIGS. 3 (*a*) to 3(*c*). Therefore, the LED 60 does not necessarily consume the electric power proportional to the instantaneous value of the AC voltage wave.

However, as illustrated in FIG. 3 (*a*), when the ignition timing (ignition phase angle) of the triac 42 is relatively delayed (conduction time is short), and the instantaneous value of the voltage wave is low, then the driving current is continuously supplied to the LED 60 after the electric power, which is required to turn ON the LED 60, is stored in the capacitor 84 (electric storage unit).

For example, in the example illustrated in FIG. 3 (*a*), the conduction time of time of the triac 42 is the period of time of 30 degrees ranging from the ignition phase angle θ=150° in the latter half of the positive half cycle to the phase angle θ=180°. The instantaneous value of the commercial sine wave AC current (100 V) in Japan, which is provided at the ignition phase angle of 150 degrees, is 70.7 V which is sufficient to turn ON the LED element (operation voltage: for example, 24 to 30 V).

However, the instantaneous voltage of the sine wave AC current is steeply decreased from the ignition phase angle 150 degrees to 180 degrees. Therefore, the range between the phase angle of 150 degrees for supplying 70.7 V and the phase angle of (about 168 degrees) for supplying 35 V that is the half 70.7 V at 150 degree is selected as the range of utilization to obtain the suitable operation in the driving circuit power source for the LED elements for constructing the LED 60. The power source for LED, which is stable and continuous, can be generated by the driving circuit 80 by charging the large capacitance capacitor (capacitor 84) during the period of time of 18 degrees as described above.

As for the charging current for the capacitor 84 required in the example described above, the electric power consumed during the period of time of 180 degrees, namely half cycle of AC current, is charged within the period of time of 18 degrees. Therefore, the charging current is about 10 times of the current consumed in the steady state. For example, in the case of the LED illumination apparatus which consumes 30 W (watt), 0.3 Arms is provided at 100 Vrms (rms represents the effective value of the AC current) in view of the time average. However, the average current, which ranges from the phase angle of 150 degrees to the phase angle of 168 degrees, is approximately calculated to be about 3 [A] which is ten times the above. This value is an allowable current value.

However, the charging current is approximately about 0.3 A in the range of the phase of 90 degrees±45 degrees in which the instantaneous voltage is greater than 100 volt.

When the power source of the LED 60 is constructed as described above, it is possible to determine the driving current of LED independently from the ignition phase angle of the triac 42. As a result, the luminance of the LED 60 may be controlled on the basis of the intention of the user independently from the conduction angle of the triac 42.

The light adjustment apparatus 40 illustrated in FIG. 2 is an existing light adjustment apparatus using the triac 42 and the dial as the operation unit 47, and may adjust the ignition phase angle θ (see FIG. 3(*a*) to (*c*)) of the triac 42 to an arbitrary value ranging from 0° to 180°, depending on the amount of rotation (operation amount) of the knob of the operation unit 47.

In the first embodiment, in order to avoid any confusion of the explanation, the following definition is provided so that the numerical value of the position angle of the operation unit (dial) 47 of the light adjustment apparatus 40 is coincident with the numerical value of the ignition phase angle in the AC current period.

That is, the dial is rotatable by 90° leftwardly and rightwardly (counterclockwise and clockwise) about the center of the position of twelve o'clock. The "position of three o'clock", which is the end point of the rotation of the dial in the clockwise direction, is referred to as "angle position 180 degrees", which is defined such that the ignition phase angle is 180 degrees and the ordinary electric power consumption is the minimum. Further, the "position of nine o'clock", which the end point of the rotation of the dial in the counterclockwise direction, is referred to as "angle position 0 degree", which is defined such that the ignition phase angle is 0 degree and the ordinary electric power consumption is the maximum. Further, in the following description, the operation, in which the luminance (light emission amount) of the LED 60 is adjusted, is referred to as "light adjustment", and the operation, in which the color temperature of the LED 60 is adjusted, is referred to as "color adjustment".

Figure 4:
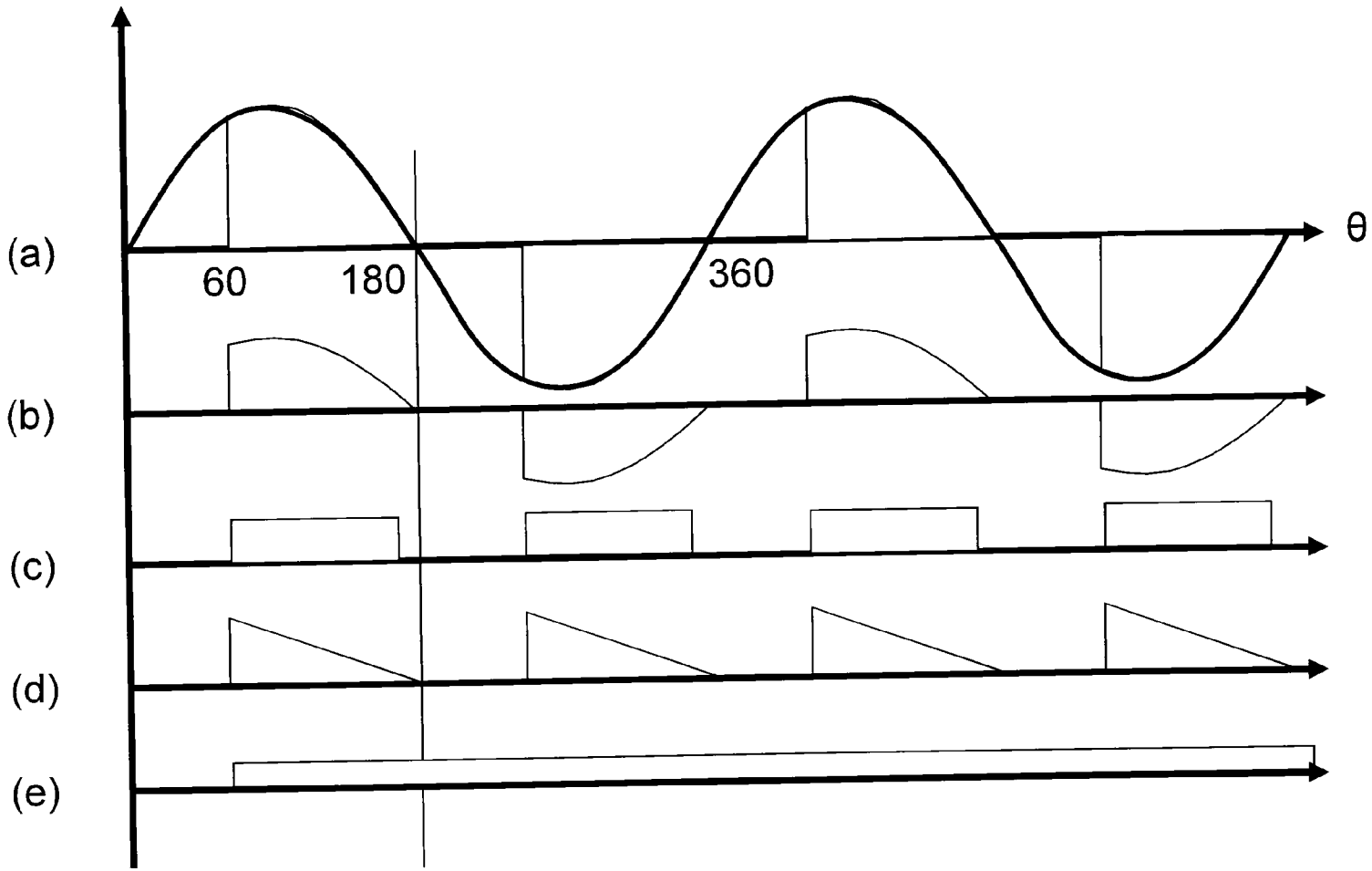
FIG. 4 is an explanation diagram illustrating AC voltage, driving current, and etc. during light adjustment.
Figure 5:
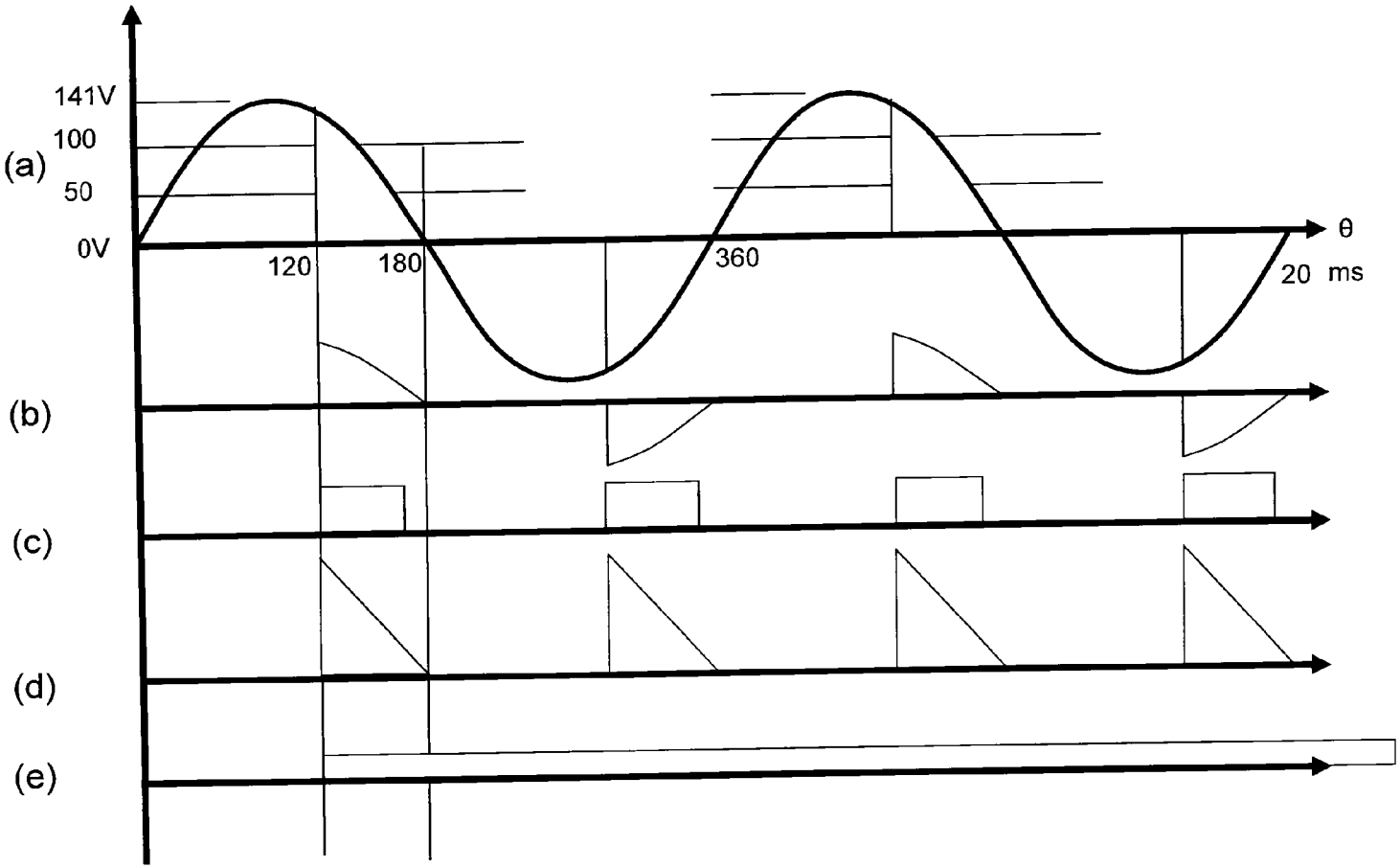
FIG. 5 is an explanation diagram illustrating AC voltage, driving current and etc. during color adjustment.

Exemplary operations will be explained below, which are to be performed during the light adjustment and during the color adjustment of the LED 60. FIG. 4 illustrates the waveform of, for example, the AC voltage and the driving current during the light adjustment. FIG. 5 illustrates the waveform of, for example, the AC voltage and the driving current during the color adjustment.

The LED 60 is turned ON (subjected to the lighting) by closing (turning ON) the main power source switch 41 (FIG. 2) by the user. The luminance and the color temperature of the LED 60 are not determined when the main power source is turned ON. However, for example, it is also possible to provide such an arrangement that the LED 60 is turned ON (subjected to the lighting) at a predetermined luminance and a predetermined color temperature in accordance with the initial setting of the microcomputer 100.

The user, as a first step, intends that the luminance is changed to have a desired value, and the user rotates the operation unit 47 (dial) leftwardly or rightwardly. The user rotates the dial while confirming the brightness by looking at the light coming from the LED 60. For example, when the user sets the dial to the position of eleven o'clock, as illustrated in FIG. 4 (*a*), a state is given, in which the ignition phase angle is fixed at 60°. In this stage, the LED 60 is subjected to the lighting at a luminance slightly brighter than the middle of the range of the adjustable luminance. If the user is satisfied by this luminance, then the user judges that any further dial operation is unnecessary, and the user releases the hand from the dial. This action is interpreted by the microcomputer 100 as described later on as the representation of intention to complete the first step.

In the first step, the microcomputer 100 executes the light adjustment operation program during the period until the user releases the hand from the operation unit 47 after the main power source is turned ON, and the operation is performed in the first step. In this embodiment, the microcomputer 100 performs the operation in accordance with the light adjustment operation program as the initial state of the microcomputer 100 brought about by the application (turning ON) of the main power source. That is, the microcomputer 100 is operated in the light adjustment mode.

In accordance with the execution of the light adjustment operation program, the microcomputer 100 momentarily measures the position of rotation of the dial, i.e., the ignition phase angle (conduction period) of the triac 42. The microcomputer 100 controls the constant current circuit 91 in accordance with the measured ignition phase angle (conduction period) to increase/decrease the total value ($I_{lowk}$+$I_{hik}$) of the driving current $I_{lowk}$ supplied to the LED group 60*a* for constructing the LED 60 and the driving current $I_{hik}$ supplied to the LED group 60*b*. As a result, the luminance of the LED 60 is updated to have a desired value. The user momentarily adjusts the position of the angle of rotation of the dial of the operation unit 47 while observing the brightness of the LED 60, and thus it is possible to allow the luminance to have a desired brightness. After that, when the state, in which the ignition phase angle (conduction time) is not changed, is continued for a predetermined time (for example, 5 seconds) by releasing the hand from the operation unit 47 by the user as described above, then the microcomputer 100 completes the execution of the light adjustment operation program, and the microcomputer 100 starts the execution of the color adjustment operation program. That is, the control mode is switched into the color adjustment mode.

As a second step, it is assumed that the user determines the further change of the color temperature to a desired value. For example, the user rotates the operation unit 47 (dial) leftwardly/rightwardly again from the position of eleven o'clock within the first stop time which is within 10 seconds and which is to be provided 5 seconds after the release of the hand from the operation unit 47 in the first step. The user operates the dial while looking at the color temperature of the LED 60. When the desired color temperature is exhibited, the user releases the hand from the operation unit 47 (dial) again. For example, it is assumed that the user releases the hand at the position of thirteen o'clock. In this case, as illustrated in FIG. 3 (*b*), the ignition phase angle of the AC is fixed at 120°.

The microcomputer 100 changes the ratio between the value of the driving current $I_{lowk}$ and the value of the driving current $I_{hik}$ without changing the luminance of the LED 60, i.e., in a state that the sum of the LED driving currents ($I_{lowk}$+$I_{hik}$) being maintained constant during the execution of the color adjustment operation program, i.e., in the color adjustment mode. Accordingly, the color temperature of the LED 60 is changed. In the case that the time in which the dial is not operated, i.e., the time in which the ignition phase angle (conduction time) is not changed, the microcomputer 100 starts the time measurement by the timer. If any change of the operation (conduction time) is not detected before the elapse of a predetermined time (for example, 5 seconds), then it is judged that the color adjustment operation by the user is completed, and the control mode is returned to the light adjustment mode in the state in which the ratio between the driving currents $I_{lowk}$ and $I_{hik}$ is fixed. On the other hand, when the operation starts again, i.e., the change of the conduction time is detected before the timer measures the predetermined time, then the microcomputer 100 completes the time measurement by the timer, and the color adjustment mode is maintained.

The microcomputer 100 may continue the time measurement by the timer if the timer measures the predetermined time (5 seconds) in the light adjustment mode, and the control mode is switched from the light adjustment mode to the color adjustment mode. If a predetermined time elapses from the mode change, for example, if the timer measures 10 seconds after the starting the measurement of time, then it is judged that the user has no intention of the color adjustment. In this case, the microcomputer 100 switches the control mode into the light adjustment mode in a state that the ratio between the values of the driving currents $I_{lowk}$ and $I_{hik}$ at a time point of change of the light adjustment mode is fixed.

The LED illumination apparatus 50 (LED 60), which is the load for the light adjustment apparatus 40 as the triac light dimmer, is operated in accordance with the exemplary operation as described above. Therefore, the rule, which should be learned by the user before when the user utilizes the LED illumination apparatus 50, is the following simple rule. That is, the present control mode (one of the light adjustment mode and the color adjustment mode) is continued on condition that the operation of the operation unit 47 is continued at an interval within 5 seconds. The control mode is switched when the dial operation is halted (stopped) for 5 or more seconds.

The numerical value of 5 seconds described above is the value which can be changed depending on, for example, the socially accepted idea or common sense, the age bracket or age group, and the social rank or status of the user. That is, the numerical value can be set in conformity with the preference of the market. According to an experiment carried out by the present inventors, such knowledge has been obtained that the range, in which the user feels the convenience, is 4 seconds±2 seconds (2 to 6 seconds). The predetermined time, in which the ignition phase angle (conduction time) is not changed, can be appropriately set. It is also allowable to provide a user interface for changing the predetermined time set in the microcomputer 100. In the exemplary operation described above, the explanation has been made about the case in which the same predetermined time of 5 seconds is used as the opportunity for the mode switching in both of the light adjustment mode and the color adjustment mode. However, it is also allowable that the length of the predetermined time differs between the light adjustment mode and the color adjustment mode.

The explanation has been made such that the microcomputer 100 changes the color temperature while maintaining the constant luminance in the exemplary operation of the color adjustment mode described above. The operation in the color adjustment mode will be explained in detail below.

FIGS. 4 (*a*) and (*b*) illustrate the relationship between the conduction voltage of the triac 42 (light adjustment apparatus 40) and the driving current of the LED 60. The shape of wave illustrated in FIG. 4 (*b*) is the shape of current wave provided when the illumination apparatus is a simple resistance load (for example, an incandescent bulb). As appreciated from FIGS. 4 (*a*) and (*b*), it is well-known that the shape of voltage wave is similar to the shape of current wave.

On the other hand, FIG. 4 (*c*) illustrates the current waveform provided when the constant current driving load is used as in this embodiment. It is appreciated that the shape of current wave illustrated in FIG. 4 (*c*) is completely different from shape of the AC voltage wave illustrated in FIG. 4 (*a*). That is, in the LED illumination apparatus 50 which contains the constant current driving circuit (constant current circuit 81), the substantially constant driving current is supplied to the load (LED 60) irrelevant to the time-dependent change of the voltage just after ignition to phase angle of 180°.

Further, it is possible to design the rectifier circuit 83 such that the capacitor 84 is charged with the large charging current immediately after the ignition as indicated by the shape of the charging wave (triangular wave) illustrated in FIG. 4 (*d*), the DC voltage is maintained, and thus the driving current is continuously supplied to the LED 60 as the load as well after the completion of the AC phase of 180° (after the completion of the half cycle) as indicated by the driving current shape of wave illustrated in FIG. 4 (*e*). FIGS. 4 (*c*), (*d*), (*e*) show the shape of the current waves after the full-wave rectification by the rectifier circuit 83.

As described above, the relatively large current, which charges the capacitor 84, is supplied from the rectifier circuit 83 immediately after the ignition of the triac 42. Accordingly, it is possible to maintain the DC voltage as illustrated in FIG. 4 (*e*) irrelevant to the dial position (operation amount) of the triac light adjustment apparatus 40. Therefore, the LED 60 can be driven at the desired current value.

An explanation will be made with reference to FIGS. 5 (*a*) and (*b*) about the relationship between the operation of the light adjustment apparatus 40 and the load current consumed by the LED 60 in addition to the operation procedure ranging from the eleven o'clock position to the thirteen o'clock position as performed by the user as described above.

When the user rotates the operation unit 47 (dial) of the light adjustment apparatus 40 in the clockwise direction, then the transition is caused to the state in which the ignition phase angle is 120 degrees as illustrated in FIG. 5 (*a*) from the state in which the ignition phase angle is 60 degrees as illustrated in FIG. 4 (*a*), and the conduction time is decreased. In this situation, if the illumination instrument is a simple resistance load such as the incandescent bulb, the current, which has the shape of wave proportional to the voltage as illustrated in FIG. 5 (*b*), is allowed to flow. However, in this embodiment, the current does not flow as in FIG. 5 (*b*). The current, which charges the capacitor 84, is allowed to flow as illustrated in FIG. 5 (*d*), and the capacitor 84 is charged with the current which has the magnitude that is approximately twice the magnitude of the current illustrated in FIG. 4 (*d*), immediately after the ignition. This situation is caused such that the voltage of the capacitor 84 is gradually lowered by the current consumed by LED because the non-conduction time of the AC current is so long, and the difference in the electric potential between that of the AC power source and that of the capacitor 84 becomes larger.

When the capacitance of the capacitor 84 is large enough, even if the ignition phase angle is 120 degrees, and the conduction time is decreased, then the load current, which is substantially the direct current as illustrated in FIG. 5 (*e*), can be continuously supplied to the LED 60. FIGS. 5 (*c*), (*d*), (*e*) illustrate the DC current waveforms after the full-wave rectification by the rectifier circuit 83.

Further, in the case of the LED illumination apparatus having the incandescent bulb-interchangeable type in which it is difficult to utilize the capacitor 84 having the large capacitance, the intermittent DC current as illustrated in FIG. 5 (*c*) is supplied to the LED 60. However, when the human eye cannot make any distinction from the lighting brought about by the continuous supply of the DC current as illustrated in FIG. 5 (*e*), it is also possible to apply the supply of the DC current as illustrated in FIG. 5 (*c*).

As described above, it is possible to secure the DC power source to be supplied to the LED 60 irrelevant to the dial position of the operation unit 97 of the light adjustment apparatus 40. Therefore, the LED driving current $I_{lowk}$ for the low Kelvin temperature and the LED driving current $T_{hik}$ for the high Kelvin temperature can be adjusted as illustrated in FIGS. 6 (*a*) and (*b*).

Figure 6:
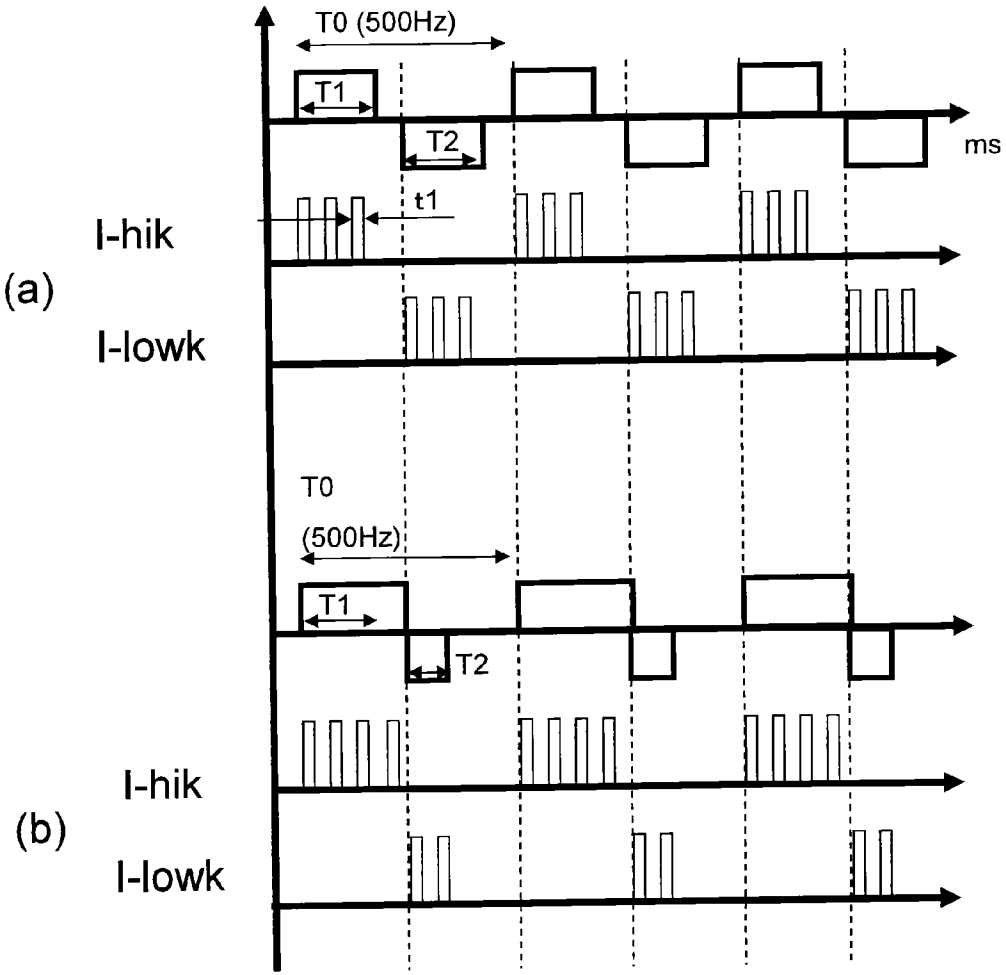
FIG. 6 is a diagram illustrating waveforms to indicate change of a driving current ratio by balance adjustment.

That is, the driving currents, which are in the same amount, can be supplied as illustrated in FIG. 6 (*a*) in relation to the driving current $I_{lowk}$ and the driving current $I_{hik}$ upon the completion of the first step (light adjustment mode). On the other hand, for example, when the dial is moved to the position of thirteen o'clock in the color adjustment mode, as illustrated in FIG. 6 (*b*), the driving current $I_{hik}$ is increased, while the driving current $I_{lowk}$ is decreased. A bluish white color is provided as a whole. The operation as described above is realized by changing the ratio between the driving current $I_{hik}$ and the driving current $I_{lowk}$ by means of the PWM circuit contained in the balance circuit 82.

As illustrated in FIGS. 6 (*a*) and (*b*), the pulse currents of the time t1 are supplied to the LED groups 60*a*, 60*b* at the time ratio determined by the balance circuit 82 during the positive and negative 1 cycle periods of time of the AC current. In the example illustrated in FIG. 6 (*a*), the pulse currents of the same number (three) are supplied to the LED groups 60*a*, 60*b*. On the other hand, in the case of FIG. 6 (*b*), the four pulse currents are supplied to the LED group 60*b*, while the two pulse currents are supplied to the LED group 60*a*. In this way, the current ratio is changed, but the total number of the pulses is not changed. That is, the total value of the driving currents is constant. Therefore, it is possible to change the color temperature in the state in which the luminance is maintained.

Effects of the First Embodiment

In the first embodiment, existing wiring lines and existing triac light adjustment apparatus 40 are utilized. Then, the operation history of the operation unit 47 (knob) of the triac light adjustment apparatus 40, namely the ignition phase angle (conduction time) of the triac is memorized at the side of illumination instruments. Thus, the two operation modes of the light adjustment mode and the color adjustment mode are realized. Accordingly, it is possible to realize the two functions of the light adjustment and the color adjustment by using the existing light adjustment apparatus 40 without carrying out any wiring construction work.

The two types of control, i.e., the light adjustment and the color adjustment can be realized by one light adjustment apparatus 40. Therefore, it is possible to extremely easily introduce the LED illumination apparatus which is capable of carrying out the light adjustment and the color adjustment, by changing the bulb or the light source disposed on the load side to the LED illumination apparatus 50 without carrying out any exchange construction work for exchanging the light adjustment apparatus.

Accordingly, the high performance can be realized by using the LED illumination apparatus for the conventional illumination system in which the incandescent bulb or the fluorescent lamp has been used. Further, in the case of the white illumination, it is possible to realize the color representation performance which is more approximate to the spectrum of the solar rays.

Further, since varying the emission spectrum (color temperature) is easier than the prior arts, the color temperature may be varied continuously in a wide range ranging from the daylight color to the incandescent bulb color in spite of one illumination apparatus.

The first embodiment is illustrative of the exemplary configuration in which the conduction time is measured on the basis of the ignition phase angle, and the history of the conduction time is recorded in the memory 101. In place of this configuration, it is also appropriate that the ignition phase angle is simply detected for every predetermined cycle (for example, 1 cycle) without measuring the conduction time, and the history of the ignition phase angle is recorded in the memory 101. The explanation has been made such that the hysteresis of the ignition phase angle (conduction time) is recorded in the memory 101. However, it is appropriate that at least the lastly detected ignition phase angle (conduction time) is recorded in the memory 101.

The first embodiment may modified, in consideration with restoration from the electrical outage, so that a non-volatility recording medium is applied to the memory 101, and total amount of the average current supplied to the LED 60 at a present and a ratio between average currents supplied to each of the LED groups 60*a*, 60*b* at a present are stored in the non-volatility recording medium. In this case, when it is restored from the electrical outage, the luminance adjusting unit 103 performs an adjusting operation for supplying the current to the LED 60 according to the total amount stored in the non-volatility recording medium while the color adjusting unit 104 performs an adjusting operation for which currents flow the LED groups 60*a*, 60*b* according to the ratio stored in the non-volatility recording medium. Thereby, at the time of restoration, the LED 60 may emit a light having the luminance and the color temperature before the electrical outage.

The non-volatility recording medium may further store mode information indicating a control mode selected at a present. In this case, at the time of restoration, it is possible to restart operations of the control mode which has been selected at the time of electrical outage. The non-volatility recording medium may further store a current timer value. The non-volatility recording medium may be prepared independent from the memory 101.

In the first embodiment, it has been explained that the LED illumination apparatus, which has the two terminals (the LED illumination apparatus including the terminals T3, T4), adjusts the luminance and the chromaticity (color temperature) in response to the conduction time of the triac 42. The "conduction time" may be interpreted as ON time of the electric power (voltage or current) periodically supplied from the light adjustment apparatus 40 to the LED illumination apparatus 50 via the two terminals (terminals T3, T4). In other words, the LED illumination apparatus may detect the ON time of the power supplied via the two terminals to adjust the luminance and the chromaticity depending on the ON time. Therefore, the first embodiment may be modified so that the LED illumination apparatus includes, in place of the ignition phase angle detection circuit 90, a detection circuit configured to detect a periodical ON time from the DC power source, and the detection circuit inputs a signal representing the ON time to the mode judging unit 102. As the detection circuit, for example, a circuit interprets a DC current outputted from the rectifier circuit 91 corresponding to the DC power source as a PWM signal (pulse) to measure ON time of the pulse may be utilized. In such modification, the mode judging unit 102 employs the ON time inputted from the detection circuit instead of the conduction time without executing a process to calculate the conduction time from the ignition phase angle.

In the first embodiment, the mode is switched when the conduction time is not changed for a predetermined time (five minutes). In other words, the mode is switched under a condition that a state that the change of the conduction time (ON time) is not changed continues more than the threshold value (predetermined time). In the first embodiment, a common threshold value is used with respect to both of switching from the light adjustment mode (first mode) to the color adjustment mode (second mode) and switching from the color adjustment mode (second mode) to the light adjustment mode (first mode). However, threshold values (first and second threshold values) which are different from each other may be used with respect to each of the switching from the light adjustment mode to the color adjustment mode and the switching from the color adjustment mode to the light adjustment mode.

Second Embodiment

Next, a second embodiment will be explained. The second embodiment is configured in the same manner as the first embodiment. Therefore, different points or features will be principally explained. The configuration, which is equivalent to that of the first embodiment, is omitted from the explanation.

In the second embodiment, the high convenience is realized by realizing the two functions of the light adjustment and the color adjustment by means of only the small-scale wiring instrument exchange construction work by exchanging the existing triac light adjustment apparatus 40 with a novel light adjustment apparatus unlike the first embodiment.

Figure 7:
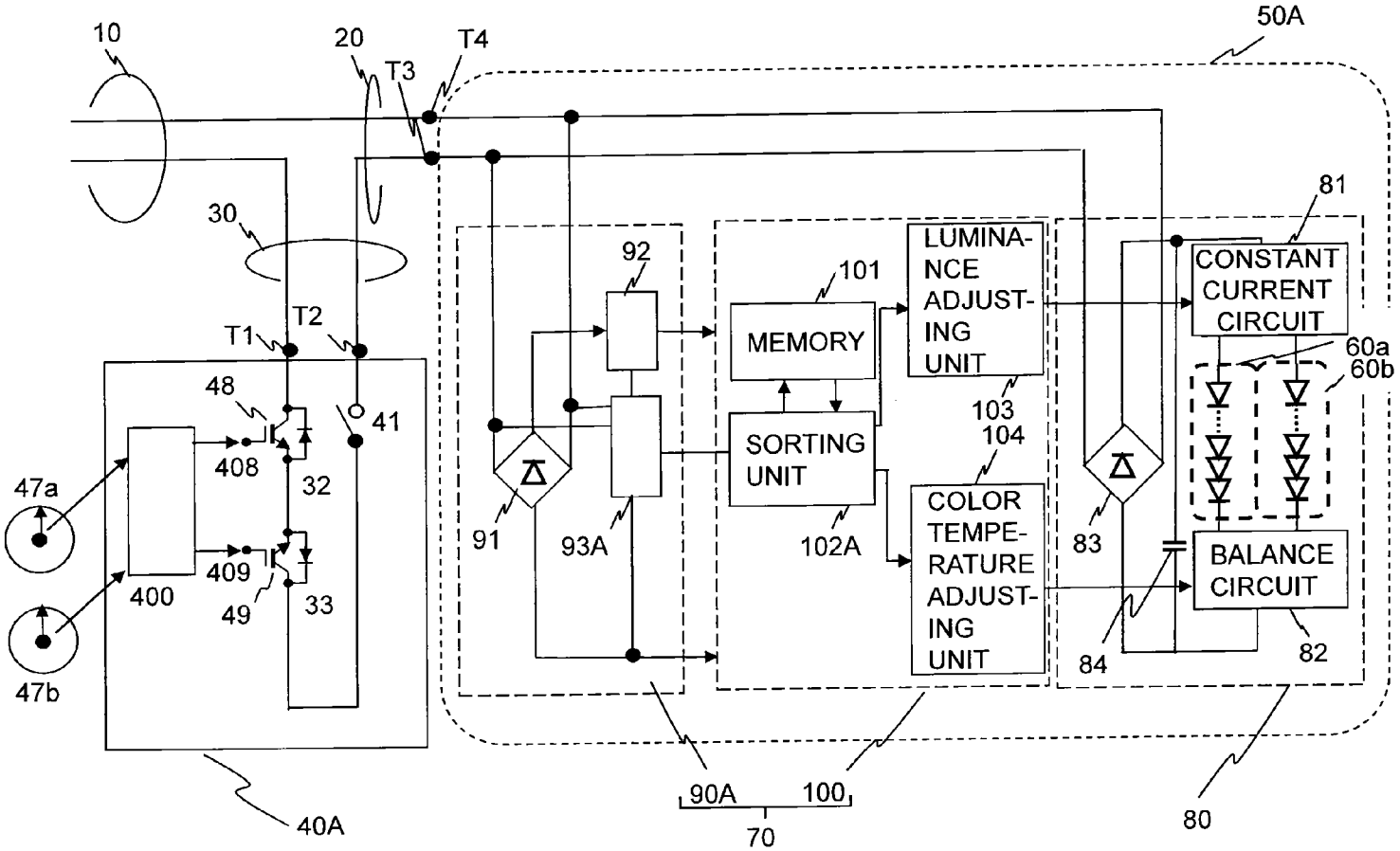
FIG. 7 is a diagram a circuit configuration example for an illumination system in the second embodiment.

FIG. 7 illustrates an exemplary circuit arrangement of an LED illumination system related to the second embodiment. The LED illumination system comprises a light adjustment apparatus 40A and an LED illumination apparatus 50A. The existing wiring lines (bus lines 10, power supply lines 20, and lead-out lines 30), which are the same as those of the first embodiment, are also utilized in the second embodiment. In the second embodiment, the light adjustment apparatus 40A is applied, which has two or more operation units including an operation unit 47*a* for the light adjustment and an operation unit 47*b* for the color adjustment. Accordingly, it is possible to provide the LED illumination system in which the convenience is improved as compared with the first embodiment.

The light adjustment apparatus 40A is provided with a pair of IGBT's (insulated gate bipolar transistors) as first and second shaping units. IGBT can switch on and off the high voltage output with the low voltage input signal. IGBT is a discrete bipolar transistor. Therefore, as illustrated in FIG. 7, two IGBT's 48, 49 are connected in series while providing the opposite polarities. IGBT's 48, 49 are provided with diodes 32, 33 respectively.

The light adjustment apparatus 40A is provided with the operation unit 47*a* for the light adjustment (first user interface) and the operation unit 47*b* for the color adjustment (second user interface). Each of the operation unit 47*a* and the operation unit 47*b* has a dial (knob) for adjusting each of the luminance and the color temperature. The signal, which indicates the operation amount of each of the operation units 47*a*, 47*b*, is imparted to a logic circuit 400.

The logic circuit 400 includes two rotary encoders (not illustrated) for detecting the respective operation amounts (angles of rotation of the dials) of the operation units 47*a*, 47*b* respectively. The logic circuit 400 supplies the signals 408, 409 to the gates of IGBT's 48, 49 at the timing corresponding to the dial position of the operation unit 47*a* (detection position of the rotary encoder). The signal 408 is the current in the opposite direction to stop the current between the collector and the emitter for a predetermined period of time. The output timing of the signals 408, 409 depends on the dial position of the operation unit 47*a*. When the signals 408, 409 are supplied to the gates of the IGBT's 48, 49, it is possible to stop the conduction of the current (current allowed to flow in the positive half cycle of the AC current from the commercial power source) allowed to flow between the collector and the emitter of IGBT's 48, 49 for a predetermined period of time (for example, 1 ms).

Figure 8:
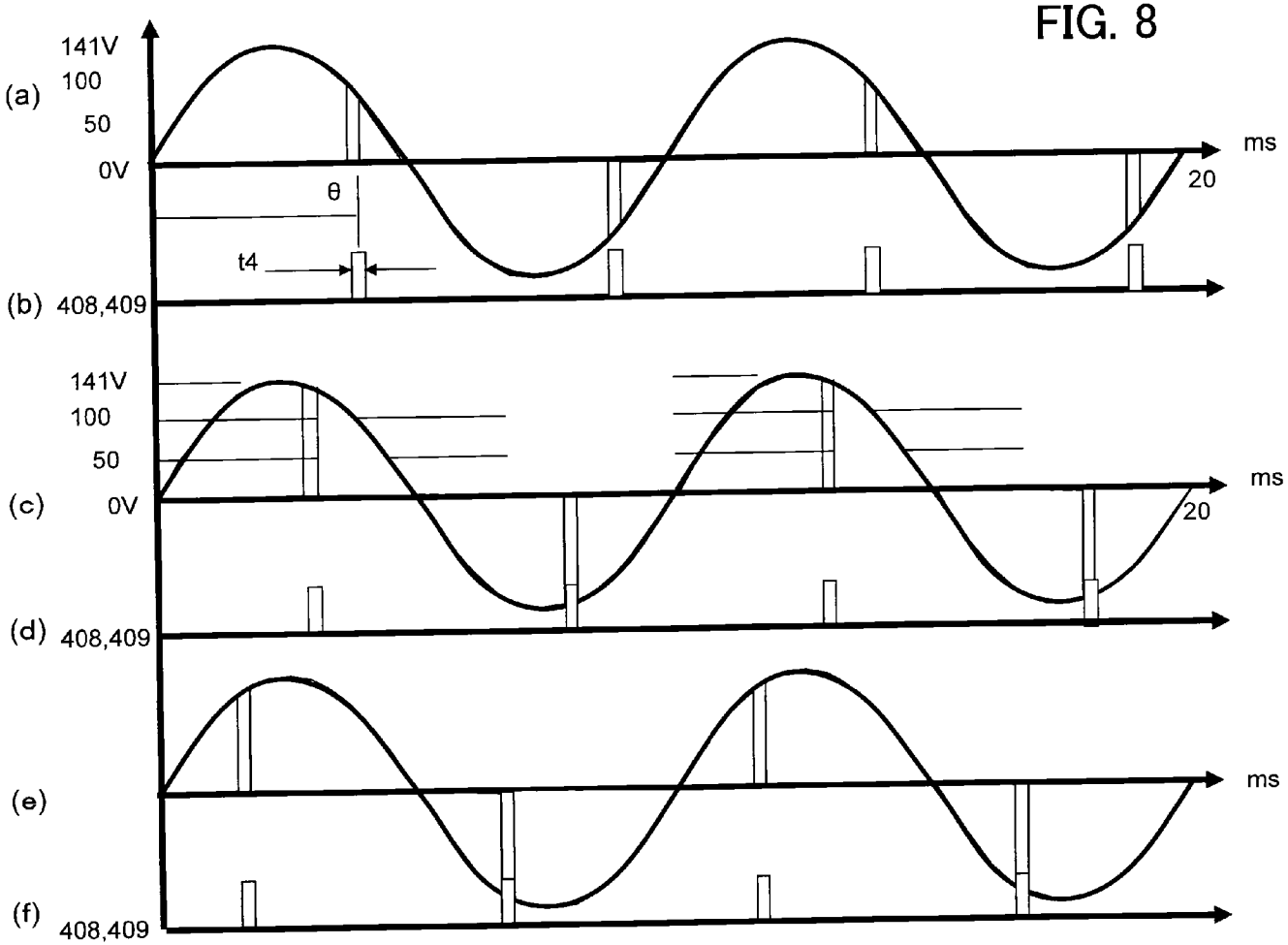
FIG. 8 is a diagram illustrating a relationship between operation amount of an operation unit and AC current waveform.

FIG. 8 illustrates the relationship between the operation amount of the operation unit 47*a* and the shape of AC wave. As illustrated in FIG. 8 (*a*), the pulse signals (signals 408, 409), which correspond to the operation amount of the operation unit 47*a* as illustrated in FIG. 8 (*b*), are generated in the respective positive and negative half cycles of the AC current, and the pulse signals are imparted to the gates of IGBT's 48, 49. Accordingly, the AC current is shut off (discontinued) for a predetermined period of time t4 (for example, 1 ms) in each of the positive and negative half cycles.

Accordingly, the positive and negative half cycles of the AC voltage supplied from the commercial power source have the shape of waves in such a state that the positive and negative half cycles are shut off for the predetermined period of time t4 at the shutoff timings in accordance with the output timings of the signals 408, 409 corresponding to the operation amount of the operation unit 47*a*. The AC voltage, which has the wave shape as described above, is supplied to the LED illumination apparatus 50A. The predetermined period of time t4 is the short time such as 1 ms as compared with the period of time of the half cycle (10 ms, in the case of 50 Hz). Therefore, it is possible to consider that the AC voltage is substantially a sine wave.

The shutoff timing, which is based on the pulse signal (signal 408) in the positive/negative half cycle of the AC voltage, depends on the amount of rotation (operation amount) of the dial of the operation unit 47*a*, i.e., the control amount of the luminance. As illustrated in FIG. 8 (*c*) and FIG. 8 (*e*), as the operation amount of the dial is increased in the direction in which the luminance is increased, the output timing of the signal 408, 409 is advanced, and the shutoff timing is advanced in the positive/negative half cycle of the AC current. Accordingly, the wave shape of the positive and negative half cycles of the AC voltage, which are supplied to the LED illumination apparatus 50A, can be in such a state that the control signal for adjusting the luminance is embedded or buried (added) therein (thereto).

Further, the logic circuit 400 supplies the signal 409 corresponding to the dial position of the operation unit 47*b* to the gate of IGBT 49. The current, which is allowed to flow between the collector and the emitter of IGBT 49 in the negative half cycle of the AC current from the commercial power source, can be subjected to the conduction stop (shutoff) for a predetermined time (for example, 1 ms) in accordance with the supply of the signal 409.

Figure 9:
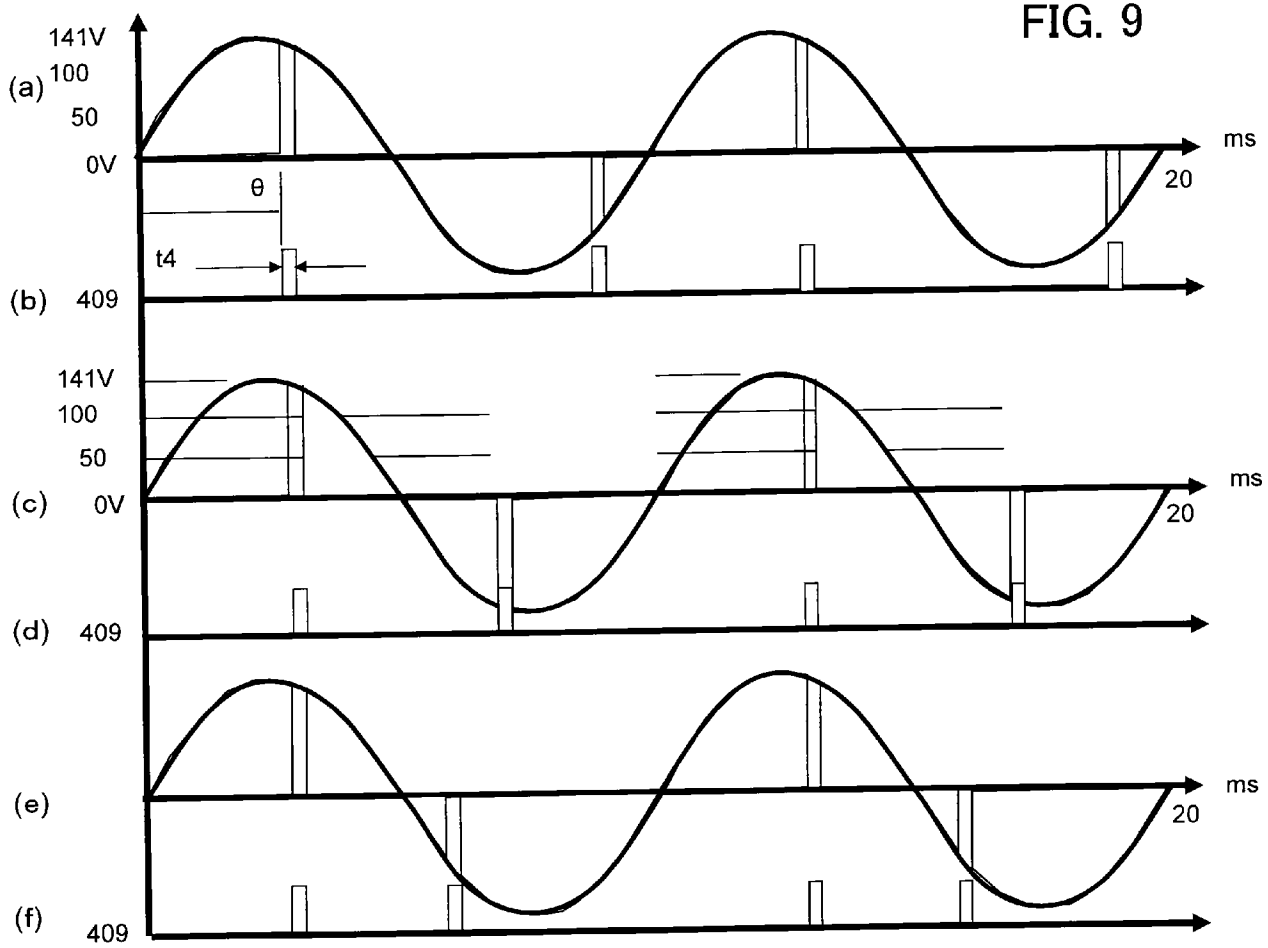
FIG. 9 is a diagram illustrating a relationship between operation amount of an operation unit and AC current waveform.

FIG. 9 illustrates the relationship between the operation amount of the operation unit 47*b* and the shape of AC wave. As illustrated in FIG. 9 (*a*), the pulse signal (signal 409) as illustrated in FIG. 9 (*b*) is generated in the negative half cycle of the AC current, and the signal is imparted to the gate of IGBT 49. Accordingly, the AC current is shut off (discontinued) for a predetermined period of time t4 (for example, 1 ms) in the negative half cycle.

Accordingly, the negative half cycle of the AC voltage supplied from the commercial power source has the shape of wave in such a state that the negative half cycle is shut off (discontinued) for the predetermined period of time t4 at the shutoff timing corresponding to the output timing of the signal 409. The AC voltage, which has the shape of wave as described above, is supplied to the LED illumination apparatus 50A. The predetermined period of time t4 is the short time such as 1 ms as compared with the half cycle period of time (10 ms, in the case of 50 Hz). Therefore, it is possible to consider that the AC voltage is substantially a sine wave.

The shutoff timing, which is based on the pulse signal (signal 409) in the negative half cycle of the AC voltage, depends on the amount of rotation of the knob of the operation unit 47*b*, i.e., the control amount of the color temperature. As illustrated in FIG. 9 (*c*) and FIG. 9 (*d*), as the operation amount of the knob is increased in the direction in which the color temperature is lowered, the output timing of the signal 409 is advanced, and the shutoff timing is advanced in the negative half cycle of the AC current. Accordingly, the wave shape of the negative half cycle of the AC voltage, which is supplied to the LED illumination apparatus 50A, can be in such a state that the control signal for adjusting the color temperature is embedded or buried (added) therein (thereto).

As described above, when the operation unit 47*a* is operated, then the signals 408, 409 are generated, and thus the shutoff positions (shutoff phase angles) are varied in the positive and negative half cycles. On the other hand, when the operation unit 47*b* is operated, then only the signal 409 is generated, and only the shutoff position (shutoff angle) is varied in the negative half cycle, for the following reason. That is, it is judged on the side of the control device that the control signal for the light adjustment is provided when the positive and negative shutoff positions are simultaneously varied, while it is judged that the control signal for the color adjustment is provided when only the negative shutoff position is varied. However, it is also allowable that the operation unit 47*a* is used as the operation unit for the color adjustment, and the operation unit 47*b* is used as the operation unit for the light adjustment. Alternatively, it is also allowable that only the signal 408 is generated in accordance with the operation of the operation unit 47*b*, and only the shutoff position in the positive half cycle is varied.

The LED illumination apparatus 50A includes a shutoff angle detection circuit 90A. The detection circuit 90A is provided with a rectifier circuit 91 which converts the AC current supplied from the side of the light adjustment apparatus 40A into the DC current, a constant voltage source 92 which generates the operating DC voltage for operating the microcomputer 100 from the DC voltage outputted from the rectifier circuit 91, and an angle detection circuit 93A which detects the shutoff timings in the positive and negative half cycles of the AC current.

The angle detecting unit 93A detects the shutoff phase angles θ (corresponding to light adjustment information and color adjustment information) in the positive and negative half cycles respectively, and the shutoff phase angles θ are delivered to a sorting unit 102A (including judging unit) of the microcomputer 100. The sorting unit 102A records the shutoff phase angles θ in the positive and negative half cycles respectively as the hysteresis information in the memory 101. In this procedure, when the sorting unit 102A detects the positive and negative shutoff phase angles θ in 1 cycle, the sorting unit 102A compares the respective shutoff phase angles θ with the positive and negative shutoff phase angles θ lastly recorded in the memory 101. In this procedure, if both of the positive and negative shutoff phase angles θ are varied (any difference is provided), the sorting unit 102A feeds the detected shutoff phase angles θ to the luminance adjusting unit 103 on the basis of the judgment that the light adjustment operation is carried out.

On the other hand, if only the negative shutoff phase angle θ is varied in the comparison of the shutoff phase angles θ, the sorting unit 102A feeds the detected shutoff phase angle θ to the color temperature adjusting unit 104 on the basis of the judgment that the color adjustment operation is carried out.

The luminance adjusting unit 103, the color temperature adjusting unit 104, and the LED 60 are constructed in approximately the same manner as in the first embodiment. That is, the luminance adjusting unit 103 controls the supply of the driving current by the constant current circuit 81 so that the LED 60 emits the light at the luminance corresponding to the shutoff phase angle θ. That is, the luminance adjusting unit 103 controls the constant current circuit 81 so that the driving current, which is predetermined depending on the shutoff phase angle θ, is supplied to the LED 60.

For example, when the AC voltage wave shape supplied to the LED illumination apparatus 50A is as illustrated in FIG. 8 (*a*), the luminance adjusting unit 103 interprets that the user desires the light emission of the LED 60 at the low luminance, because the shutoff phase angle θ is positioned at the latter half of the positive (negative) half cycle. Assuming that the interpretation as described above is affirmed, the luminance adjusting unit 103 controls the constant current circuit 81 so that the driving current is supplied with the relatively small driving current value which is predetermined with respect to the shutoff phase angle θ.

Further, when the shape of the AC voltage wave is as illustrated in FIG. 8 (*c*), the luminance adjusting unit 103 interprets that the user desires the light emission of the LED 60 at the middle or intermediate luminance, because the shutoff phase angle θ is positioned at the middle of the positive (negative) half cycle. Assuming that the interpretation as described above is affirmed, the luminance adjusting unit 103 controls the constant current circuit 81 so that the driving current is supplied with the relatively middle or intermediate driving current value which is predetermined with respect to the shutoff phase angle θ.

Further, when the shape of the AC voltage wave is as illustrated in FIG. 8 (*e*), the luminance adjusting unit 103 interprets that the user desires the light emission of the LED 60 at the high luminance, because the shutoff phase angle θ is positioned at the former half of the positive (negative) half cycle. Assuming that the interpretation as described above is affirmed, the luminance adjusting unit 103 controls the constant current circuit 81 so that the driving current is supplied with the relatively high driving current value which is predetermined with respect to the shutoff phase angle θ. However, the foregoing example does not show that the luminance is controlled at the three stages. The luminance can be controlled at two or more stages corresponding to the value of the shutoff phase angle θ.

The color temperature adjusting unit 104 controls the operation of the balance circuit 82 so that the LED 60 emits the light at the color temperature corresponding to the negative shutoff phase angle θ. That is, the driving currents are supplied to the LED group 60*a* (low color temperature LED (LED for the low Kelvin temperature)) and the LED group 60*b* (high color temperature LED (LED for high Kelvin temperature)) for constructing the LED 60 respectively at the driving current ratio corresponding to the negative shutoff phase angle θ.

For example, when the shape of the AC voltage wave supplied to the LED illumination apparatus 50A is as illustrated in FIG. 9 (*a*), the shutoff phase angle θ is positioned at the latter half of the negative half cycle. In this case, assuming that the user desires the light emission of the LED 60 at the high color temperature, the color temperature adjusting unit 104 controls the balance circuit 1082 so that the driving currents are supplied to the LED groups 60*a*, 60*b* at the balance (ratio) predetermined with respect to the shutoff phase angle θ.

Further, when the shape of the AC voltage wave supplied to the LED illumination apparatus 50A is as illustrated in FIG. 9 (*c*), the shutoff phase angle θ is positioned at the middle of the negative half cycle. In this case, assuming that the user desires the light emission of the LED 60 at the middle or intermediate color temperature, the color temperature adjusting unit 104 controls the balance circuit 82 so that the driving currents are supplied to the LED groups 60*a*, 60*b* at the balance (ratio) predetermined with respect to the shutoff phase angle θ.

Further, when the shape of the AC voltage wave is as illustrated in FIG. 9 (*e*), the shutoff phase angle θ is positioned at the former half of the negative half cycle. In this case, assuming that the user desires the light emission of the LED 60 at the low color temperature, the color temperature adjusting unit 104 controls the balance circuit 1082 so that the driving currents are supplied to the LED groups 60*a*, 60*b* at the balance (ratio) predetermined with respect to the shutoff phase angle θ. However, the foregoing example does not show that the color temperature is controlled at the three stages. The color temperature can be controlled at two or more stages corresponding to the value of the shutoff phase angle θ.

The shutoff phase angles θ in the positive and negative half cycles, which are based on the signals 408, 409, are recorded in the memory 101. Therefore, if the shutoff phase angle θ is not detected by the angle detection circuit 93, the sorting unit 102A supplies the positive and negative shutoff phase angles θ lastly recorded in the memory 101 to the luminance adjusting unit 103 and the color temperature adjusting unit 104. Accordingly, even if the time t4 is 0, i.e., even if the shutoff time of t4 is extinguished, then the luminance and the color temperature are maintained.

The microcomputer 100 functions as detecting means (detection unit), first control means (first control unit), second control means (second control unit). The sorting unit 102A corresponds to the detecting means, the luminance adjusting unit 103 corresponds to the first control means, and the color adjusting unit 104 corresponds to the second control means.

According to the second embodiment, the light adjustment apparatus 40A has the operation unit 47*a* for adjusting the luminance and the operation unit 47*b* for adjusting the color temperature. Accordingly, the user can carryout the light adjustment operation and the color adjustment operation independently from each other. Therefore, it is possible to provide the LED illumination system in which the operability is improved as compared with the first embodiment.

The existing wiring equipment is also used in the second embodiment. Therefore, it is possible to avoid any large-scale wiring construction work which would be otherwise required to introduce the LED illumination apparatus 50A. It is possible to reduce the initial cost upon the introduction of the LED illumination apparatus 50A.

As well as the first embodiment, the second embodiment may modified, in consideration with restoration from the electrical outage, so that a non-volatility recording medium is applied to the memory 101, and total amount of the average current supplied to the LED 60 at a present and a ratio between average currents supplied to each of the LED groups 60*a*, 60*b* at a present are stored in the non-volatility recording medium. In this case, when it is restored from the electrical outage, the luminance adjusting unit 103 performs an adjusting operation for supplying the current to the LED 60 according to the total amount stored in the non-volatility recording medium while the color adjusting unit 104 performs an adjusting operation for which currents flow the LED groups 60*a*, 60*b* according to the ratio stored in the non-volatility recording medium. Thereby, at the time of restoration, the LED 60 may emit a light having the luminance and the color temperature before the electrical outage.

The above-described embodiments have been explained with respect to an example of the light adjustment apparatus using the triac. However, as switching elements or switching circuits instead of the triac, it is possible to apply a circuit which is configured by elements such as, for example, MOSFET, circuits using transistor etc., IGBT, SCR (Silicon Controlled Rectifier). The configurations in the embodiments explained above can be appropriately combined with each other.

According to the embodiments, it makes possible to adjust both of luminance and color temperature of an LED illumination by utilization of a lighting apparatus series-connected with an LED illumination apparatus to a power source. Further, according to the embodiments, it makes possible to provide an LED lighting apparatus which is able to adjust both of luminance and chromaticity of LED by using a voltage or a current supplied from a power source via two electric lines.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. An LED illumination apparatus configured to be connected with a light adjustment apparatus, which is connected with a power source via a single first power feeding line, via a single second power feeding line, configured to be connected with the power source via a single third power feeding line, and configured to receive an AC current supplied from the power source during a conduction time depending on an ignition phase angle of a conduction control unit in response to an operation amount of a user interface included in the light adjustment apparatus, the LED illumination apparatus comprising:

first and second LED modules configured to emit lights having a same color with different emission spectra or lights having different colors;

a measurement unit configured to measure the ignition phase angle and time change of the ignition phase angle;

light adjusting means configured to supply a driving current, by using the received AC current, for the first and second LED modules emitting a light having a luminance depending on the ignition phase angle;

a color adjusting unit configured to supply a driving current, by using the received AC current, for the first and second LED modules emitting a light having a color temperature depending on the ignition phase angle;

a selecting unit configured to switch a control mode to be select based on the time change of the ignition phase angle between a light adjustment mode that a driving current adjusted by the light adjusting unit is supplied to the first and second LED modules and a color adjustment mode that a driving current adjusted by the color adjusting unit is supplied to the first and second LED modules;

a light adjustment control unit configured to control the light adjusting means so that the first and second LED modules emit a light having a luminance based on the ignition phase angle in a state that the light adjustment mode is selected;

a color adjustment control unit configured to control the color adjusting unit so that the first and second LED modules emit a light having a color temperature depending on the ignition phase angle in a state that the color adjustment mode is selected.

2. The LED illumination apparatus according to claim 1, wherein the selecting unit selects either the light adjustment mode or the color adjustment mode when a main power source of the LED illumination apparatus is turned on, and switches one of the light adjustment mode and the color adjustment mode into the other mode in a condition that a time for the ignition phase angle not to change exceeds a threshold value in one of the light adjustment mode and the color adjustment mode.

3. The LED illumination apparatus according to claim 1, wherein the selecting unit maintains the light adjustment mode when the time change of the ignition phase angle is within a given range in a state that the light adjustment mode is selected, and the light adjusting unit supplies a driving current of an average current value corresponding to magnitude of the ignition phase angle.

4. The LED illumination apparatus according to claim 1, wherein the color adjusting unit, in a state that the color adjustment mode is selected, adjusts a ratio of driving currents which are supplied to the first and second LED modules so that the color temperature is raised in a reduction tendency of the ignition phase angle while the color temperature is decreased in an increasing tendency of the ignition phase angle.

5. The LED illumination apparatus according to claim 1, further comprising a pair of two terminals consisting of a first terminal connected with the light adjustment apparatus via one of a pair of power feeding lines and a second terminal connected with the power source via the other of the pair of power feeding lines.

6. The LED illumination apparatus according to claim 1, further comprising an electric storage unit configured to store electrical charge for the light adjusting unit or the color adjusting unit continuing supply of the driving current using the received AC current after the conduction time.

7. An LED illumination system, comprising:

a light and color adjusting apparatus connected with a power source via a single feeding line; and an LED illumination apparatus including a first terminal connected with the light and color adjusting apparatus via one of a pair of feeding lines and a second terminal connected with the power source via the other of the pair of feeding lines, wherein the light and color adjusting apparatus including:

a first user interface to adjust a luminance;

a second user interface to adjust a color temperature;

a first shaping unit configured to shape an AC voltage waveform supplied form the power source so as to include a luminance control signal corresponding to an operation amount of the first user interface; and a second shaping unit configured to shape an AC voltage waveform supplied from the power source so as to include a color temperature control signal corresponding to an operation amount of the second user interface, wherein the LED illumination apparatus including:

a pair of terminals, one of the pair of terminals being connected with the light and color adjusting apparatus and the other of the pair of terminals being connected with the power source;

first and second LED modules configured to emit lights having a same color with different emission spectra or lights having different colors;

a judging unit configured to determine whether the AC voltage waveform received from the light and color adjusting apparatus includes the luminance control signal or includes the color temperature control signal;

a light adjusting unit configured to supply a driving current for adjusting a luminance to the first and second LED modules;

a color adjusting unit configured to supply a driving current for adjusting a color temperature to the first and second LED modules;

a light adjustment control unit configured to control the light adjusting unit so that the first and second LED modules emit a light having a luminance corresponding to the luminance control signal; and a color adjustment control unit configured to control the color adjusting unit so that the first and second LED modules emit a light having a color temperature corresponding to the color temperature control signal.

8. The LED illumination system according to claim 7, wherein one of the first shaping unit and the second shaping unit generates a section that a voltage of a given amount is reduced in both of positive and negative cycles of the AC voltage waveform depending on an operation amount of the first user interface or the second user interface;

the other of the first shaping unit and the second shaping unit generates a section that a voltage of a given amount is reduced in one of positive and negative cycles of the AC voltage waveform depending on an operation amount of the first user interface or the second user interface;

the judging unit judges whether the AC voltage waveform includes the luminance control signal or includes the color temperature control signal by determining whether the section that the voltage of the given amount is reduced is changed in both of the positive and negative cycles of the AC voltage waveform or not.

9. The LED illumination system according to claim 7, wherein the light adjustment control unit controls the light adjusting unit so that the luminance becomes lower according to decrease of a phase angle indicating a position of the luminance control signal within the AC voltage waveform.

10. The LED illumination system according to claim 7, wherein the color temperature adjustment control unit controls the color adjusting unit so that a color temperature becomes higher according to decrease of a phase angle indicating a position of the luminance control signal within the AC voltage waveform.

11. A light and color adjustment apparatus, comprising:

a first terminal connected to a power source;

a second terminal connected to one of a pair of terminals included in an LED illumination apparatus, the other of the pair of terminals being connected to the power source;

a first user interface to adjust a luminance;

a second user interface to adjust a color temperature;

a first shaping unit configured to shape an AC voltage waveform supplied from the power source via the first terminal so as to include a luminance control signal corresponding to an operation amount of the first user interface; and a second shaping unit configured to shape an AC voltage waveform supplied from the power source via the first terminal so as to include a color temperature control signal corresponding to an operation amount of the second user interface, wherein the AC voltage waveform shaped by the first shaping unit and the second shaping unit is sent to the LED illumination apparatus via the second terminal.

12. An LED illumination apparatus, comprising:

a pair of terminals consisting of a first terminal connected with a light and color adjustment apparatus, which is connected to a power source, and a second terminal connected with the power source;

first and second LED modules configured to emit lights having a same color with different emission spectra or lights having different colors;

a judging unit configured to judge whether an AC voltage waveform received from the light and color adjusting apparatus includes a luminance control signal or includes a color temperature control signal;

a light adjusting unit configured to supply a driving current for adjusting luminance to the first and second LED modules;

a color adjusting unit configured to supply a driving current for adjusting color temperature to the first and second LED modules;

a light adjustment control unit configured to control the light adjusting unit so that the first and second LED modules emit a light having a luminance corresponding to the luminance control signal; and a color adjustment control unit configured to control the color adjusting unit so that the first and second LED modules emit a light having a color temperature corresponding to the color temperature control signal.

* * * * *